US012559272B2

(12) United States Patent
Forssblad et al.

(10) Patent No.: US 12,559,272 B2
(45) Date of Patent: Feb. 24, 2026

(54) ROBOT SYSTEM AND METHOD FOR COIL PACKAGING WITH DIFFERENT ANGULAR VELOCITIES

(71) Applicant: LAMIFLEX GROUP AB, Nykoping (SE)

(72) Inventors: Marcus Forssblad, Stigtomta (SE); Björn Molin, Nykoping (SE)

(73) Assignee: LAMIFLEX GROUP AB, Nykoping (SE)

( * ) Notice: Subject to any disclaimer, the term of this patent is extended or adjusted under 35 U.S.C. 154(b) by 0 days.

(21) Appl. No.: 18/877,801

(22) PCT Filed: Jun. 20, 2023

(86) PCT No.: PCT/SE2023/050635

§ 371 (c)(1),
(2) Date: Dec. 20, 2024

(87) PCT Pub. No.: WO2023/249546

PCT Pub. Date: Dec. 28, 2023

(65) Prior Publication Data

US 2025/0382082 A1 Dec. 18, 2025

(30) Foreign Application Priority Data

Jun. 22, 2022 (SE) ..... 2250772-7

(51) Int. Cl.
*B65B 11/04* (2006.01)
*B65B 25/24* (2006.01)
(Continued)

(52) U.S. Cl.
CPC ..... *B65B 11/045* (2013.01); *B65B 25/24* (2013.01); *B65B 27/06* (2013.01); *B65B 35/58* (2013.01); *B65B 57/14* (2013.01)

(58) Field of Classification Search
CPC ..... B65B 11/045; B65B 25/24; B65B 27/06; B65B 35/58; B65B 57/14
See application file for complete search history.

(56) References Cited

U.S. PATENT DOCUMENTS 5,086,983 A * 2/1992 Darrieux ..... B29C 53/588 242/434.8
6,324,820 B1 12/2001 Gelfman et al.
(Continued)

FOREIGN PATENT DOCUMENTS

EP 3070008 A1 9/2016
WO 2016195578 A1 12/2016
(Continued)

OTHER PUBLICATIONS

International Search Report, International Application No. PCT/SE2023/050635, Mailing Date: Sep. 6, 2023.

*Primary Examiner* — Thomas M Wittenschlaeger
(74) *Attorney, Agent, or Firm* — MEDLER FERRO WOODHOUSE & MILLS PLLC

(57) ABSTRACT

A robot system and a method for packaging coils of sheet metal. The method and robot system for coil packaging, having two industrial robots, each robot being provided with a robot arm provides for a solution where the angular velocity of the coil is adjusted during the wrapping process to thereby provide reinforcement of a certain cylindrical sector segment of the coil.

22 Claims, 4 Drawing Sheets

(51) Int. Cl.

| | |
|---|---|
| ***B65B 27/06*** | (2006.01) |
| ***B65B 35/58*** | (2006.01) |
| ***B65B 57/14*** | (2006.01) |

(56) References Cited

U.S. PATENT DOCUMENTS

| | | | | |
|---|---|---|---|---|
| 6,705,060 | B1 * | 3/2004 | McGuinness | B65B 25/24 53/409 |
| 10,604,287 | B2 * | 3/2020 | Tegström | B65B 11/045 |
| 2016/0272351 | A1 * | 9/2016 | Faehrenkaemper | B65B 25/24 |

FOREIGN PATENT DOCUMENTS

| | | | |
|---|---|---|---|
| WO | 2021219861 | A2 | 11/2021 |
| WO | 2022139673 | A1 | 6/2022 |

* cited by examiner

ROBOT SYSTEM AND METHOD FOR COIL PACKAGING WITH DIFFERENT ANGULAR VELOCITIES

CROSS-REFERENCE TO PRIOR APPLICATIONS

This application is a § 371 National Stage Application of PCT International Application No. PCT/SE2023/050635 filed Jun. 20, 2023, which claims priority to Swedish Patent Application No. 2250772-7 filed Jun. 22, 2022, both of which are incorporated herein in their entirety.

TECHNICAL FIELD

In general, the present disclosure relates to apparatus, system and methods for packaging articles with wrapping material. More specifically, the present disclosure relates to a robot system, a computer program product and methods for packaging annular articles, such as coils of sheet metal, being rotated while being packaged with a wrapping material.

BACKGROUND

The wrapping of coils of sheet metal is generally time consuming in the production of sheet metal. Different solutions for automatized coil wrapping are available. Although working well, there is a demand for reducing the risk that the coil or the wrapping material or film applied to the surface of the coil is damaged yet provide for an improved or sufficiently high productivity of the process for wrapping the coil with a wrapping material.

RELATED ART

The patent publication WO2016/195578 shows a setup of linear robots configured for wrapping sheet metal coils.

Another patent publication U.S. Pat. No. 6,705,060B1 shows a similar setup of linear robots configured for wrapping sheet metal coils.

In the patent publication EP3070008A1 there is shown a setup of robots with more degrees of freedom rendering a more flexible configuration. However, this disclosure lacks the practical solutions to make such a configuration work well in practice.

OBJECT OF DISCLOSED EMBODIMENTS

The object of embodiments disclosed herein is to provide a robot tool, system and method that overcomes the drawbacks of the known related art in enabling a faster total process and/or fast enough wrapping process, to wrap an annual object, or example a coil, that also reduces the risk that the coil and/or the wrapping material applied to the surfaces of the coil is damaged after the coil is wrapped with the wrapping material.

Another object of the technology disclosed is to reduce the risk that a coil and/or the wrapping material applied to the surfaces of the coil is damaged yet provide for an improved or sufficiently high productivity of the process for wrapping the coil with a wrapping material.

Yet another object of the technology disclosed is to eliminate and/or reduce the need for a separate protection device, for example a more advanced mechanical edge protection device, for a wrapped coil yet provide for an improved or sufficiently high productivity of the total process for protecting the coil from mechanical, physical and/or chemical damage.

Further object of the technology disclosed is to provide a locally thicker application, or locally more layers of film than for the rest of the coil, to thereby eliminate and/or reduce that a particular, for example pre-determined, cylindrical sector segment of the coil, and/or the wrapping material applied to the particular cylindrical sector segment, is damaged by the gripping of the wrapped coil by means of a gripping machine or tool that is gripping at least portions of the area of the cylindrical sector segment, for example when the wrapped coil is subsequently moved away from the cradle.

Further object of the technology disclosed is to provide a locally thicker application, or locally more layers of film than for the rest of the coil, to thereby eliminate and/or reduce that a particular, for example pre-determined, cylindrical sector segment of the coil, and/or the wrapping material applied to the particular cylindrical sector segment, is damaged by the contact surface that at least portions of the area of the particular cylindrical sector segment of the wrapped coil is resting, for example damage caused by surface friction of the ground on which the wrapped coil is resting.

SUMMARY

The technology disclosed relates to methods, a computer program product and a robot system for wrapping coils, including a control system for controlling the angular velocity, or rotational speed, of the coil and movements of at least two industrial robots each comprising at least one robot arm.

In example applications and embodiments, the technology disclosed aims at reducing the risk that a coil and/or the protective wrapping material applied to the surfaces of the coil is damaged when portions of the curved envelope surface, or cylindrical surface, of a certain cylindrical sector segment of the coil that is intended to be resting on a contact surface after completion of the wrapping process, and/or a certain cylindrical sector segment is damaged by the gripping of the coil after application of the wrapping material or film, for example when the coil is moved away from the cradle by means of a gripping machine or gripping tool.

In embodiments, the technology disclosed relates to methods, a computer program product and a robot system for controlling the movements of at least two industrial robots used for wrapping, in successive wrapping turns, the surfaces of a coil with a wrapping material such as a stretch film. The robot system comprises a computer program product and a control system configured to control the angular velocity, or rotational speed, of the coil during the application of the wrapping material to the surfaces of the coil and the movements of the at least two industrial robots and the respective at least one robot arm.

In aspects, the technology disclosed relates to a robot system comprising a control system configured to control means for conveying a rotational motion to the coil in order to adjust and change the angular velocity, or rotational speed, of the coil about its longitudinal axis during the process of wrapping the coil to thereby change the amount of overlap between successive wrapping turns or windings of wrapping material so that the cylindrical surface of at least one first cylindrical sector segment of the coil is provided with a greater overlap between successive turns or windings of the wrapping material than the overlap of the cylindrical surface of at least one other second cylindrical sector segment of the coil.

In embodiments, the technology disclosed relates to methods, computer program product and a control system for automatically adjusting and changing the angular velocity, or rotational speed, of the coil during the wrapping process by adjusting the angular velocity, or rotational speed, of the at least one coil roller of the cradle carrying the coil. The rotation of the at least one coil roller conveys a rotational motion to the coil placed in the cradle. According to various embodiments and depending on the diameter of the coil to be wrapped with a wrapping material and the diameter of the at least one coil roller, a certain change in the angular velocity, or rotational speed, for the at least one coil roller will correspond to a certain change in the angular velocity, or rotational speed, for the coil placed on the at least one coil roller in the cradle.

According to embodiments and aspects of the technology disclosed, the control system of the robot system is configured to adjust an change the angular velocity, or rotational speed, of the rotating coil rollers of the cradle during the wrapping process which conveys a rotational motion to the coil in order to adjust and change the angular velocity of the coil placed in the cradle to thereby, in turn, adjust and change the overlap of stretch film between successive wrapping turns.

In embodiments, the control system of the robot system is configured to adjust and change the angular velocity, or rotational speed, of the rotating coil rollers of the cradle so that the entire area of the cylindrical surface of at least one first cylindrical sector segment of the coil is provided with multiple layers of stretch film, i.e. at least a double layer of film over the entire cylindrical surface area.

In aspects, the technology disclosed relates to a robot system comprising a cradle for carrying a coil and a control system configured to control means for conveying a rotational motion to the coil where the means for conveying a rotational motion to the coil is in the form of at least one coil roller which is part of the cradle. The control system may then be configured to adjust and change, by changing the angular velocity of the at least one coil roller, the angular velocity, or rotational speed, of the coil about its longitudinal axis during the process of wrapping the coil to thereby change the amount of overlap between successive wrapping turns or windings of wrapping material so that the cylindrical surface of at least one first cylindrical sector segment of the coil is provided with a greater overlap between successive turns or windings of the wrapping material than the overlap of the cylindrical surface of at least one other second cylindrical sector segment of the coil.

In embodiments, the robot system comprises a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material. The control system may then be configured to control the means for conveying a rotational motion to the coil in order to adjust and change the angular velocity, or rotational speed, of the coil about its longitudinal axis during the process of wrapping the coil to thereby change the amount of overlap between successive wrapping turns or windings of wrapping material so that the cylindrical surface of at least one first cylindrical sector segment of the coil is provided with a greater overlap between successive turns or windings of the wrapping material than the overlap of the cylindrical surface of at least one other second cylindrical sector segment of the coil.

In embodiments, the robot system comprises a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material. The control system may then be configured to control the movements of the robots in relation to the coil in order to wrap the coil with the wrapping material in successive wrapping turns or windings each comprising a sequence of robot movements including two handovers of the robot tool between the two robots per wrapping turn where a first handover phase takes place in a hollow cylindrical center core of the coil and a second handover phase takes place along a curved envelope surface of the coil. The control system may then be further configured to control the means for conveying a rotational motion to the coil in order to adjust and change the angular velocity, or rotational speed, of the coil about its longitudinal axis during the process of wrapping the coil to thereby change the amount of overlap between successive wrapping turns or windings of wrapping material so that the cylindrical surface of at least one first cylindrical sector segment of the coil is provided with a greater overlap between successive turns or windings of the wrapping material than the overlap of the cylindrical surface of at least one other second cylindrical sector segment of the coil.

In embodiments, the control system, by controlling the means for conveying a rotational motion to the coil, is configured to adjust and change the angular velocity, or rotational speed, of the coil so that at least one lower angular velocity, or rotational speed, of the coil imposed by the means for conveying a rotational motion to the coil during at least portions of the time for wrapping the at least one first cylindrical sector segment is less than 70% of a higher rotational speed imposed on the coil during the wrapping of the at least one other second cylindrical sector segment of the coil, thereby providing a reinforcement of the at least one first cylindrical sector segment.

In embodiments, the control system, by controlling the means for conveying a rotational motion to the coil, is configured to adjust and change the angular velocity, or rotational speed, of the coil so that the coil does not rotate during at least portions of the time period for wrapping the at least one first cylindrical sector segment.

In embodiments, the control system, by controlling the means for conveying a rotational motion to the coil, is configured to adjust and change the angular velocity, or rotational speed, of the coil during the wrapping process so that the coil is rotating at at least one lower angular velocity, or rotational speed, during at least 5 successive wrapping turns or windings.

In embodiments, the control system, by controlling the means for conveying a rotational motion to the coil, is configured to adjust and change the angular velocity, or rotational speed, of the coil during the wrapping process so that the at least one lower angular velocity, or rotational speed, imposed by the means for conveying a rotational motion to the coil during the wrapping of the at least one first cylindrical sector segment of the coil provides for overlaps between successive wrapping turns or windings along the cylindrical surface, or curved envelope surface, of the at least one first cylindrical sector segment of the coil that are more than 50% of the width of the roll of the wrapping material, thereby providing a reinforcement of the at least one first cylindrical sector segment.

In embodiments, the control system, by controlling the means for conveying a rotational motion to the coil, is configured to and change the angular velocity, or rotational speed, of the coil during the wrapping process so that the at least one higher rotational speed imposed by the means for conveying a rotational motion to the coil during the wrapping of the at least one other second cylindrical sector segment of the coil provides for overlaps between successive wrapping turns or windings along the cylindrical surface, or curved envelope surface, of the at least one other second cylindrical sector segment of the coil that are less than 35% of the width of the roll of the wrapping material.

In embodiments, the control system of the robot system is configured to adjust an change the angular velocity, or rotational speed, of the rotating coil rollers of the cradle so that the entire area of the cylindrical surface of at least one first cylindrical sector segment of the coil is provided with multiple layers of stretch film, i.e. at least a double layer of film over the entire cylindrical surface area, whereas the cylindrical surface area of the at least one other cylindrical sector segment is provided with a combined single and dual layer of stretch film with an overlap between successive wrapping turns or windings that is less than 45% of the width of the stretch film so that portions of the cylindrical surface area of the at least one other cylindrical sector segment are only provided with a single layer of film. The application of multiple layers of stretch film to the entire cylindrical surface of the at the least one first cylindrical sector segment of the coil and where portions of the cylindrical surface area of the at least one other cylindrical sector segment is only provided with a single layer of film provides a greater protection against mechanical, physical and/or chemical damage to reduce the risk that the coil and/or the stretch film applied to the cylindrical surface of the at least one first cylindrical sector segment of the coil is damaged after the coil is wrapped with the stretch film, yet provides for an improved or sufficiently high productivity of the total process for protecting the coil from mechanical, physical and/or chemical damage.

In embodiments, the control system is configured to control the positioning of the robot arm of the respective robots so that the longitudinal axis of the roll holder shaft of the robot tool holding the roll is directed in an inclined direction relative the direction of rotation of the coil, wherein the roll holder shaft is directed in an inclined direction at least during portions of the movement of the robot tool along the cylindrical surface, or curved envelope surface, of the coil.

In embodiments, the control system is configured to control the direction of the roll holder shaft relative the direction of rotation of the coil so that the inclination of the shaft is adapted to the angular velocity, or rotational speed, imposed to the coil in that the shaft is inclined by means of the respective robot arms in a greater angle during the use of the at least one higher angular velocity than during the use of the at least one lower angular velocity of the coil.

In embodiments, the control system is configured to control the positioning of the roll holder shaft in three-dimensional space along the first circumferential edge determining the start position for the wrapping of the cylindrical surface, or curved envelope surface, of the coil so that the start position is adapted to the currently imposed angular velocity of the coil.

In embodiments, the control system is configured to control the positioning of the longitudinal axis of the roll holder shaft of the robot tool so that the shaft is positioned at an angle within an angle range of 2 to 30 degrees relative the direction of rotation along the cylindrical surface of the coil where the wrapping material is applied.

In embodiments, the control system is configured to control the movements of the robots so that the direction of travel of the robot tool and the respective robot arm holding the robot tool along the curved envelope surface is in a direction essentially parallel with the rotational axis of the coil, and wherein the longitudinal axis of the roll holder shaft of the robot tool is positioned at an angle within an angle range of 3 to 30 degrees relative the direction of rotation of a sub-area of the cylindrical surface, or curved envelope surface, where the wrapping material is applied.

In embodiments, the control system is configured to control the movements of the robots so that the direction of travel of the robot tool and the respective robot arm holding the robot tool along the cylindrical surface, or curved envelope surface, is in a direction along the curved envelope surface which is essentially parallel with the rotational axis of the coil.

In embodiments, the control system is configured to control the movement of the robot arms so that the direction of travel of the robot tool and the respective robot arm holding the robot tool along the cylindrical surface, or curved envelope surface, is in a straight direction within the angle range of 0.1 to 15 degrees relative an axis along the curved envelope surface which is parallel to the rotational axis of the coil.

In embodiments, the technology disclosed relates to methods and a robot system for coil packaging, having two industrial robots, each robot being provided with a robot arm for holding a robot tool with a roll of stretch film where the robot system is configured to adjust and change the angular velocity, or rotational speed, of the coil during the application of the wrapping material during the wrapping process so that the entire area of the cylindrical surface of at least one cylindrical sector segment of the coil is provided with multiple layers of stretch film, i.e. at least a double layer of film over the entire area, whereas the area of the cylindrical surface of the at least one other cylindrical sector segment is provided with a combined single layer of stretch film with an overlap less than 45% of the width of the stretch film so that portions of the cylindrical surface area of the at least one other cylindrical sector segment are only provided with a single layer of film. The application of multiple layers of stretch film to the entire cylindrical surface of the at the least one first cylindrical sector segment of the coil and where portions of the cylindrical surface area of the at least one other cylindrical sector segment is only provided with a single layer of film provides a greater protection against mechanical, physical and/or chemical damage to reduce the risk that the coil and/or the stretch film applied to the cylindrical surface of the at least one first cylindrical sector segment of the coil is damaged after the coil is wrapped with the stretch film, yet provides for an improved or sufficiently high productivity of the total process for protecting the coil from mechanical, physical and/or chemical damage.

According to embodiments, the control system of the robot system comprises a computer program product with stored software code and instructions, which, when executed, control the movements and travel paths of the at least two industrial robots and the respective at least one robot arm so that the travel paths for consecutive wrapping turns/laps/passes are different in order to define a certain width of the overlap of the successive wrapping passes along the curved envelope surface taking into account the outer radius of the coil and the rotational speed of the coil, e.g. the rotational speed that a pair of coil rollers of the cradle carrying the coil gives the coil placed in the cradle.

According to embodiments and aspects of the technology disclosed, the computer program product with stored software code and instructions, which, when executed, adjust an change the angular velocity, or rotational speed, of the rotating coil rollers of the cradle during the wrapping process which conveys a rotational motion to the coil in order to adjust and change the angular velocity of the coil placed in the cradle to thereby, in turn, adjust and change the overlap of stretch film between successive wrapping turns so that the entire area of the cylindrical surface of at least one cylindrical sector segment of the coil is provided with multiple layers of stretch film, i.e. at least a double layer of film over the entire area, whereas the area of the cylindrical surface of the at least one other cylindrical sector segment is provided with a combined single layer of stretch film with an overlap less than 45% of the width of the stretch film so that less than 45% of the cylindrical surface area of the at least one other cylindrical sector segment is provided with a double layer of film. The application of multiple layers of stretch film to the entire cylindrical surface of the at the least one first cylindrical sector segment of the coil provides a greater protection against mechanical, physical and/or chemical damage reduces to thereby reduce the risk that the coil and/or the stretch film applied to the surfaces of the coil is damaged after the coil is wrapped with the stretch film, yet provide for an improved or sufficiently high productivity of the total process for protecting the coil from mechanical, physical and/or chemical damage.

In aspects, the technology disclosed relates to a method for wrapping a coil in a robot system comprising a cradle for carrying the coil, a control system, means for conveying a rotational motion to the coil, the method comprising adjusting, by the control system and through the means for conveying a rotational motion of the coil, the angular velocity, or rotational speed, of the coil about its longitudinal axis during the process of wrapping the coil to thereby change the amount of overlap between successive wrapping turns or windings of wrapping material so that the cylindrical surface of the at least one first cylindrical sector segment of the coil is provided with a greater overlap between successive turns or windings of the wrapping material than the overlap of the cylindrical surface of at least one other second cylindrical sector segment of the coil.

In aspects, the technology disclosed relates to a method for wrapping a coil in a robot system comprising a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material, the method comprising adjusting, by the control system and through the means for conveying a rotational motion of the coil, the angular velocity, or rotational speed, of the coil about its longitudinal axis during the process of wrapping the coil to thereby change the amount of overlap between successive wrapping turns or windings of wrapping material so that the cylindrical surface of the at least one first cylindrical sector segment of the coil is provided with a greater overlap between successive turns or windings of the wrapping material than the overlap of the cylindrical surface of at least one other second cylindrical sector segment of the coil.

In aspects, the technology disclosed relates to a method for wrapping a coil in a robot system comprising a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material, the method comprising wrapping the coil with the wrapping material being rolled off the roll in successive wrapping turns or windings each comprising a sequence of robot movements including two handovers of the robot tool between the two robots per wrapping turn or winding, wherein a first handover phase takes place in a hollow cylindrical center core of the coil and a second handover phase takes place along a cylindrical surface, or curved envelope surface, of the coil, and where the method is further comprising adjusting, by the control system and through the means for conveying a rotational motion of the coil, the angular velocity, or rotational speed, of the coil about its longitudinal axis during the process of wrapping the coil to thereby change the amount of overlap between successive wrapping turns or windings of wrapping material so that the cylindrical surface of the at least one first cylindrical sector segment of the coil is provided with a greater overlap between successive turns or windings of the wrapping material than the overlap of the cylindrical surface of at least one other second cylindrical sector segment of the coil.

In embodiments, the method further comprising adjusting, by the control system and through the means for conveying a rotational motion to the coil, the angular velocity, or rotational speed, of the coil so that at least one lower angular velocity, or rotational speed, of the coil imposed by the means for conveying a rotational motion to the coil during at least portions of the time for wrapping the at least one first cylindrical sector segment is less than 70% of a higher rotational speed imposed on the coil during the wrapping of the at least one other second cylindrical sector segment of the coil, thereby providing a reinforcement of the at least one first cylindrical sector segment.

In embodiments, the method further comprising adjusting, by the control system and through the means for conveying a rotational motion to the coil, the angular velocity, or rotational speed, of the coil so that the coil does not rotate during at least portions of the time period for wrapping the at least one first cylindrical sector segment.

In embodiments, the angular velocity, or rotational speed, of the coil is adjusted, by the control system and through the means for conveying a rotational motion to the coil, so that the coil is rotating at at least one lower angular velocity, or rotational speed, during at least 5 successive wrapping turns or windings.

In embodiments, the method is comprising that the at least one lower rotational speed imposed by the means for conveying a rotational motion to the coil during the wrapping of the at least one first cylindrical sector segment of the coil provides for overlaps between successive wrapping turns or windings along the cylindrical surface, or curved envelope surface, of the at least one first cylindrical sector segment of the coil that are more than 50% of the width of the roll of the wrapping material, thereby providing a reinforcement of the at least one first cylindrical sector segment.

In embodiments, the method is comprising that the at least one lower rotational speed imposed by the means for conveying a rotational motion to the coil during the wrapping of the at least one first cylindrical sector segment of the coil provides for overlaps between successive wrapping turns or windings along the cylindrical surface, or curved envelope surface, of the at least one first cylindrical sector segment of the coil that are more than 70% of the width of the roll of the wrapping material, thereby providing a reinforcement of the at least one first cylindrical sector segment.

In embodiments, the method is comprising that the at least one lower rotational speed imposed by the means for conveying a rotational motion to the coil under the control of the control system and during the wrapping of the at least one first cylindrical sector segment of the coil provides for overlaps between successive wrapping turns or windings along the cylindrical surface, or curved envelope surface, of the at least one first cylindrical sector segment of the coil that are more than 90% of the width of the roll of the wrapping material, thereby providing reinforcement of the at least one first cylindrical sector segment.

In embodiments, the at least one higher rotational speed imposed by the means for conveying a rotational motion to the coil during the wrapping of the at least one other second cylindrical sector segment of the coil provides for overlaps between successive wrapping turns or windings along the cylindrical surface, or curved envelope surface, of the at least one other second cylindrical sector segment of the coil that are less than 45% of the width of the roll of the wrapping material.

In embodiments, the at least one higher rotational speed imposed by the means for conveying a rotational motion to the coil during the wrapping of the at least one other second cylindrical sector segment of the coil provides for overlaps between successive wrapping turns or windings along the cylindrical surface, or curved envelope surface, of the at least one other second cylindrical sector segment of the coil that are less than 35% of the width of the roll of the wrapping material.

In embodiments, the at least one higher rotational speed imposed by the means for conveying a rotational motion to the coil under the control system and during the wrapping of the at least one other second cylindrical sector segment of the coil provides for overlaps between successive wrapping turns or windings along the cylindrical surface, or curved envelope surface, of the at least one other second cylindrical sector segment of the coil that are less than 20% of the width of the roll of the wrapping material.

In embodiments, the width of the roll of the wrapping material is in the range 200-300 mm, and wherein the width of the overlaps produced along the cylindrical surface, or curved envelope surface, of the at least one first cylindrical sector segment of the coil is more than 150 mm.

In embodiments, the process for wrapping the entire coil includes between 15 and 50 wrapping turns or windings in total.

In embodiments, the method is further comprising adapting, by the control system, the positioning of the robot arm of the respective robots so that the longitudinal axis of the roll holder shaft of the robot tool holding the roll is directed in an inclined direction relative the direction of rotation of the coil, wherein the roll holder shaft is directed in an inclined direction at least during portions of the movement of the robot tool along the cylindrical surface, or curved envelope surface, of the coil.

In embodiments, the method is further comprising adapting, by the control system, the direction of the roll holder shaft relative the direction of rotation of the coil so that the inclination of the shaft is adapted to the angular velocity, or rotational speed, imposed to the coil in that the shaft is inclined by means of the respective robot arms in a greater angle during the use of the at least one higher angular velocity than during the use of the at least one lower angular velocity of the coil.

In embodiments, the method is further comprising positioning, by the control system, the roll holder shaft position in three-dimensional space along the first circumferential edge determining the start position for the wrapping of the cylindrical surface, or curved envelope surface, of the coil is adapted to the currently imposed angular velocity of the coil.

In embodiments, the method is further comprising positioning, by the control system, the inclination of the longitudinal axis of the roll holder shaft of the robot tool by the respective robot arm holding the robot tool, at an angle within an angle range of 2 to 30 degrees relative the direction of rotation along the cylindrical surface of the coil where the wrapping material is applied.

In embodiments, the method is further comprising controlling, by the control system, the direction of travel of the robot tool and the respective robot arm holding the robot tool along the curved envelope surface is in a direction essentially parallel with the rotational axis of the coil, wherein the longitudinal axis of the roll holder shaft of the robot tool is positioned at an angle within an angle range of 3 to 30 degrees relative the direction of rotation of a sub-area of the curved envelope surface where the wrapping material is applied.

In embodiments, the method is further comprising controlling, by the control system, the movement of the robot arms so that the direction of travel of the robot tool and the respective robot arm holding the robot tool along the cylindrical surface, or curved envelope surface, is in a direction along the curved envelope surface which is essentially parallel with the rotational axis of the coil.

In embodiments, the method is further comprising controlling, by the control system, the movement of the robot arms so that the direction of travel of the robot tool and the respective robot arm holding the robot tool along the cylindrical surface, or curved envelope surface, is in a straight direction within the angle range of 0.1 to 15 degrees relative an axis along the curved envelope surface which is parallel to the rotational axis of the coil.

In embodiments, the technology disclosed relates to a method of wrapping a coil in a robot system comprising a control system, a cradle for carrying the coil, two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material, the method comprising wrapping the coil with the wrapping material being rolled off the roll in successive wrapping turns each comprising a sequence of robot movements including two handovers of the robot tool between the two robots per wrapping turn/pass, wherein a first handover phase takes place in a hollow cylindrical center core of the coil and a second handover phase takes place along the curved envelope surface of the coil, and wherein the application of the wrapping material to the surfaces of the coil is comprising adjusting, by the control system through the means for conveying a rotational motion to the coil, the angular velocity of the coil to thereby change the overlap between successive wraps along the cylindrical surface of the coil.

In embodiments, the method comprises wrapping the coil with the wrapping material in a sequence of robot movements including two handovers of the robot tool between the two robots per lap, or wrapping revolution/pass, wherein a first handover phase takes place in a hollow cylindrical center core of the coil and a second handover phase takes place along the curved envelope surface of the coil. In certain embodiments In embodiments, at least one of the first and second handover of the robot tool between the two robots and their respective robot arms is performed while both two robot arms handing over the robot tool between them are in motion while simultaneously holding the robot tool. In example embodiments, the two robot arms are both moving during the handover taking place in the hollow cylindrical center core of the coil and/or the two robot arms are both moving during the second handover that takes place along the curved envelope surface of the coil.

In certain embodiments, and in order to achieve this handover "on-the-fly", the actuating power, e.g. pneumatic power or hydraulic power, of the robot arm of the robot handing over the robot tool to the other robot arm is reduce or turned off at a certain distance within a distance interval of 20-200 mm from the position/area, in three-dimensional space, of the handover phase when both of the two robot arms for the first time are simultaneously holding the robot tool.

In the example embodiment when the robot tool is completely turned off at a certain distance from the handover position/area, the robot tool is typically held by and locked to the coupling robot piece of the robot arm handing over the robot tool solely by mechanical force just before and during the initial phase of the handover when the robot tool is held by both robot arms, e.g. solely by mechanical spring tension. In the example embodiment when the robot tool is reduced at a certain distance from the handover position/area, the robot tool is typically held by and locked to the coupling robot piece of the robot arm handing over the robot tool partly by pneumatic power or hydraulic power and partly by mechanical force just before and during the initial phase of the handover when the robot tool is held by both robot arms. An inductive sensor on at least one of the two robot arms, or the robot tool, may be used for determining that it is time to reduce or turn off the actuating power, or the software program and control data of the robot control system may determine the time instant for reducing or shutting off the actuating power of the robot arm handing over the robot tool. These handover "on-the-fly" procedures which include reducing or shutting off the actuating power at a certain distance from the handover position/area provides for a faster handover and improved productivity because there is no need for any of the two robot arms to stand still during the handover and lose time.

In certain aspects, the technology disclosed relates to a method for wrapping a coil in a robot system comprising a robot control system, a cradle for carrying the coil, two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between the two ends and carrying a roll of wrapping material, the method comprising wrapping the coil with the wrapping material being rolled off the roll in successive wrapping turns each comprising a sequence of robot movements including two handovers of the robot tool between the two robots per wrapping turn, wherein a first handover phase takes place in a hollow cylindrical center core of the coil and a second handover phase takes place along the curved envelope surface of the coil, and wherein the application of the wrapping material to the surfaces of the coil is comprising:

a. reducing or turning off the actuating power, e.g. pneumatic power or hydraulic power, of the robot arm of the robot handing over the robot tool to the other robot arm at a certain distance within a distance interval of 20-200 mm from the handover position.

In certain aspects, the technology disclosed relates to a robot system comprising a robot control system, a cradle for carrying the coil, two industrial robots, each industrial robot being provided with at least one robot arm having a coupling robot piece configured to interface with a robot tool having two ends each configured to interface with a coupling robot piece of a robot arm, and a roll holder shaft projecting substantially perpendicular to an axis extending between the two ends and carrying a roll of wrapping material, wherein the robot control system is configured to control the movements of the robots in relation to the coil in order to wrap the coil with the wrapping material in successive wrapping turns each comprising a sequence of robot movements including two handovers of the robot tool between the two robots per wrapping turn, and wherein the robot control system is further configured to control the movements of the robots and their respective robot arm so that the application of the wrapping material to the surfaces of the coil is comprising:

a. reducing or turning off the actuating power, e.g. pneumatic power or hydraulic power, of the robot arm of the robot handing over the robot tool to the other robot arm at a certain distance within a distance interval of 20-200 mm from the handover position.

BRIEF DESCRIPTION OF DRAWINGS

Embodiments disclosed herein will be further explained with reference to the accompanying drawings, in which.

DESCRIPTION OF EMBODIMENTS

Figure 1A:
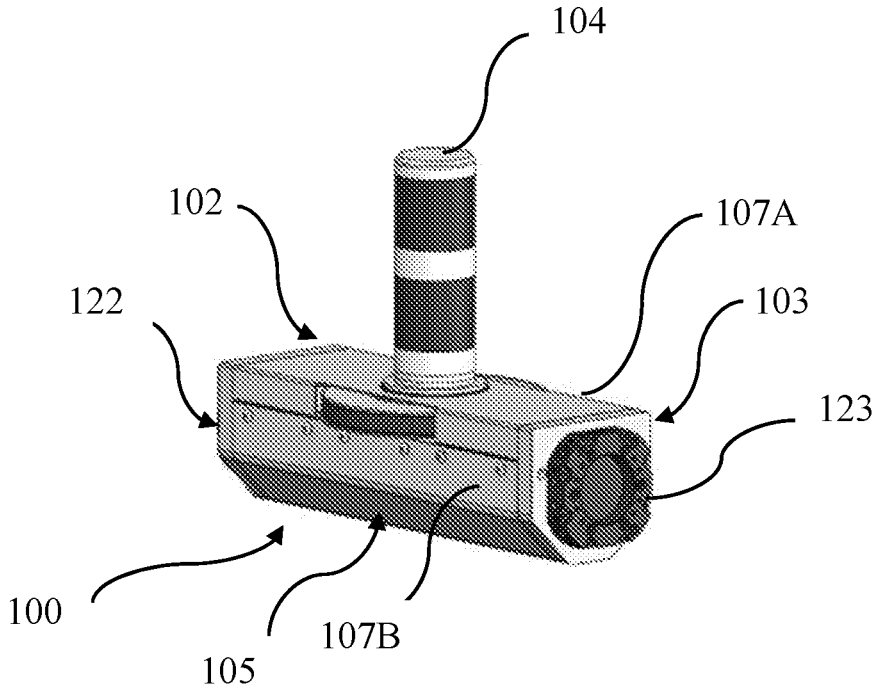
FIG. 1A illustrates schematically an embodiment of a robot tool provided with a roll holder shaft for holding a roll of wrapping material and being configured for handover between robot arms of coordinated robots.

This disclosure describes a system and apparatus for wrapping exposed surfaces of a large annular coil, including its hollow cylindrical core, to thereby prevent contamination and/or prepare the coil for shipping.

The technology disclosed relates to a system, an apparatus and methods for wrapping a coil in a robot system comprising a control system and a cradle for carrying the coil.

The method according to the technology disclosed comprises the step of adjusting the rotational speed of the coil about its longitudinal axis during the process of wrapping the coil to thereby change the amount of overlap between successive wrapping turns or windings of wrapping material so that at least one first cylindrical sector segment of the coil is wrapped with greater overlaps between successive turns or windings of the wrapping material than the overlaps produced for at least one other second cylindrical sector segment of the coil. The wrapping of a coil may typically include between 15 and 70 wrapping turns or windings.

The robot system and apparatus according to the technology disclosed comprises a control system configured to adjust and change the angular velocity, or rotational speed, of the coil about its longitudinal axis during the process of wrapping the coil to thereby change the amount of overlap between successive wrapping turns or windings of wrapping material so that at least one first cylindrical sector segment of the coil is wrapped with greater overlaps between successive turns or windings of the wrapping material than the overlaps produced for at least one other second cylindrical sector segment of the coil.

In embodiments, the robot system and apparatus according to the technology disclosed comprises a control system configured to control means for conveying a rotational motion to a coil placed in a cradle to adjust and change the angular velocity, or rotational speed, of the coil about its longitudinal axis during the process of wrapping the coil to thereby change the amount of overlap between successive wrapping turns or windings of wrapping material so that at least one first cylindrical sector segment of the coil is wrapped with greater overlaps between successive turns or windings of the wrapping material than the overlaps produced for at least one other second cylindrical sector segment of the coil.

In various embodiments and applications, the possibility of changing the amount of overlap between successive wrapping turns or windings of wrapping material during a wrapping process, which is enabled by the technology disclosed, provides a reinforcement of the at least one first cylindrical sector segment to reduce the risk that the coil and/or the wrapping material applied to the surfaces of the coil is damaged after the coil is wrapped with the wrapping material.

In various embodiments and applications, the possibility of changing the amount of overlap between successive wrapping turns or windings of wrapping material during a wrapping process, which is enabled by the technology disclosed, eliminates and/or reduces the need for a separate protection device, for example a more advanced mechanical edge protection device, for a wrapped coil yet provides for an improved or sufficiently high productivity of the total process for protecting the coil from mechanical, physical and/or chemical damage.

In various embodiments and applications, the possibility of changing the amount of overlap between successive wrapping turns or windings of wrapping material during a wrapping process, which is enabled by the technology disclosed, reduces the risk that a coil which has been wrapped with a stretch film is damaged by the gripping of a gripping tool, e.g. a crane that is gripping the wrapped coil at positions on a first cylindrical sector segment wrapped with more layers of stretch film than other areas of the coil is wrapped with, yet provides for an improved or sufficiently high productivity of the process for wrapping the coil with a wrapping material. In embodiments, the method of the technology disclosed may comprise determining, e.g. before the wrapping process begins and by the control system, the first cylindrical sector segment where the gripper tool is allowed to grip the coil after the coil has been wrapped with the stretch film.

In various embodiments and applications, the possibility of changing the amount of overlap between successive wrapping turns or windings of wrapping material during a wrapping process, which is enabled by the technology disclosed, to thereby provide a locally thicker application, or locally more layers of film than for the rest of the coil, eliminates and/or reduces that a particular first cylindrical sector segment of the coil, for example pre-determined first cylindrical sector segment of the coil, and/or the wrapping material applied to the particular first cylindrical sector segment, is damaged by the contact surface that at least portions of the area of the particular first cylindrical sector segment of the wrapped coil is resting, for example damage caused by surface friction of the ground on which the wrapped coil is resting. In embodiments, the method of the technology disclosed may comprise determining, e.g. before the wrapping process begins and by the control system, the first cylindrical sector segment where the coil is allowed to rest against an external contact surface, for example the ground.

Thus, the advantages of the technology disclosed include the possibility to adaptively provide a locally thicker application of the wrapping material, for example locally more layers of stretch film, than for the rest of the coil, to thereby eliminate and/or reduce that a particular, for example predetermined, cylindrical sector segment of the coil, and/or the wrapping material applied to the particular cylindrical sector segment, is damaged by the gripping of the wrapped coil by means of a gripping machine or tool that is gripping at least portions of the area of the cylindrical sector segment, for example when the wrapped coil is subsequently moved away from the cradle.

In embodiments, the system and apparatus may comprise a pair of robots handing off/over, or transferring, a robot tool comprising a roll of wrapping material, such as a plastic stretch film, from a coupling robot piece, for example a gripper, on one robot arm of a first robot to a coupling robot piece on the robot arm of the other robot. The system and apparatus according to the technology disclosed may then further comprise a control system configured to adjust the rotational speed of the coil about its longitudinal axis during the process of wrapping the coil. The system and apparatus may thereby be configured to change the amount of overlap between successive wrapping turns or windings of wrapping material. At least one first cylindrical sector segment of the coil may then be wrapped with greater overlaps between successive turns or windings of the wrapping material than the overlaps produced for at least one other second cylindrical sector segment of the coil. In example embodiments, the system and apparatus may be configured to adjust the rotational speed of the coil so that the resulting overlaps when wrapping at a lower rotational speed are more than 50% of the width of the roll of the wrapping material for the at least one first cylindrical sector segment of the coil and less than 45% of the width of the roll when wrapping at least one other second cylindrical sector segment at a higher rotational speed.

In aspects and embodiments of the technology disclosed, the reduction of angular velocity for a specific at least one first cylindrical sector segment down to angular velocities in the range 5-70% of the normal angular velocity for the other at least one cylindrical sector segment (where this normal angular velocity gives 5-45% overlap) gives overlaps in the range 50-95% of the width of the film and typically a thickness of 2 to 30 layers of film for the whole cylindrical surface of the at least one first cylindrical sector segment where reinforcement is needed in order to protect the at least one first cylindrical sector segment from mechanical, physical and/or chemical impact.

As an example embodiment of the technology disclosed when applying a stretch film with a width of 240 mm to a coil having a diameter of 2200 mm, the overlap between successive wraps along the cylindrical surface of the at least one first cylindrical sector segment where reinforcement is needed is within the range 120-230 mm along the cylindrical surface of the at least one first cylindrical surface segment, whereas the overlap between successive wraps along the cylindrical surface of the at least one other cylindrical sectors segments is within the range 12-110 mm.

In yet another example embodiment of the technology disclosed when applying a stretch film with a width of 100 mm to a coil having a diameter of 600 mm, the overlap between successive wraps along the cylindrical surface of the at least one first cylindrical sector segment where reinforcement is needed is within the range 50-95 mm along the cylindrical surface of the at least one first cylindrical surface segment, whereas the overlap between successive wraps along the cylindrical surface of the at least one other cylindrical sectors segments is within the range 3-270 mm.

In embodiments, the control system of the system and apparatus may be configured to adjust the rotational speed of the coil so that at least one first lower rotational speed used when wrapping the at least one first cylindrical sector segment is within the range of 5-70% of a higher second rotational speed used for wrapping the at least one other second cylindrical sector segment of the coil.

In certain embodiments, e.g. when using a combination of measures for changing the amount of overlap between successive wrapping turns or windings of wrapping material during the wrapping of the coil, the control system of the system and apparatus may be configured to adjust the rotational speed of the coil so that at least one first lower rotational speed used when wrapping the at least one first cylindrical sector segment is within the range of 5-80% of a higher second rotational speed used for wrapping the at least one other second cylindrical sector segment of the coil.

In certain embodiments, e.g. when using a combination of measures for changing the amount of overlap between successive wrapping turns or windings of wrapping material during the wrapping of the coil, the control system of the system and apparatus may be configured to adjust the rotational speed of the coil so that at least one first lower rotational speed used when wrapping the at least one first cylindrical sector segment is within the range of 70-90% of a higher second rotational speed used for wrapping the at least one other second cylindrical sector segment of the coil.

In embodiments, the system and apparatus may comprise a pair of robots handing off/over, or transferring, a robot tool comprising a roll of wrapping material, such as a plastic stretch film, from a coupling robot piece, for example a gripper, on one robot arm of a first robot to a coupling robot piece on the robot arm of the other robot.

The system and apparatus according to the technology disclosed may then further comprise a control system configured to adjust the rotational speed of the coil about its longitudinal axis during the process of wrapping the coil. The system and apparatus may thereby be configured to change the amount of overlap between successive wrapping turns or windings of wrapping material. At least one first cylindrical sector segment of the coil may then be wrapped with greater overlaps between successive turns or windings of the wrapping material than the overlaps produced for at least one other second cylindrical sector segment of the coil.

In example embodiments, the at least one first lower rotational speed used when wrapping the at least one first cylindrical sector segment is within the range of 5-70% of a higher second rotational speed used for wrapping the at least one other second cylindrical sector segment of the coil. In embodiments, the system and apparatus of the technology disclosed may then be configured to adjust the rotational speed of the coil so that the resulting overlaps when wrapping at a lower rotational speed are more than 50% of the width of the roll of the wrapping material for the at least one first cylindrical sector segment of the coil and less than 45% of the width of the roll when wrapping at least one other second cylindrical sector segment at the higher rotational speed. In certain embodiments, the system and apparatus of the technology disclosed may then be configured to adjust the rotational speed of the coil so that the resulting overlaps when wrapping at a lower rotational speed are more than 60% of the width of the roll of the wrapping material for the at least one first cylindrical sector segment of the coil and less than 45% of the width of the roll when wrapping at least one other second cylindrical sector segment at the higher rotational speed. In other embodiments, the system and apparatus of the technology disclosed may then be configured to adjust the rotational speed of the coil so that the resulting overlaps when wrapping at a lower rotational speed are more than 70% of the width of the roll of the wrapping material for the at least one first cylindrical sector segment of the coil and less than 45% of the width of the roll when wrapping at least one other second cylindrical sector segment at the higher rotational speed. In other embodiments, the system and apparatus of the technology disclosed may then be configured to adjust the rotational speed of the coil so that the resulting overlaps when wrapping at a lower rotational speed are more than 60% of the width of the roll of the wrapping material for the at least one first cylindrical sector segment of the coil and less than 40% of the width of the roll when wrapping at least one other second cylindrical sector segment at the higher rotational speed.

In embodiments, the robot system may comprise a control system, two industrial robots, each robot being provided with a robot arm having a coupling robot piece which may be configured to interface with a roll or a robot tool.

In the example embodiment and when the coupling robot piece of the robot arm interfaces directly with the roll, the method comprises wrapping the coil in a sequence of robot movements with handover of the roll of wrapping material from a first industrial robot to a second industrial robot and vice versa. The wrapping of a coil may typically include between 15 and 70 wrapping turns or windings with two handovers per wrapping turn or winding. The width of the roll of the wrapping material is typically in the range 200-300 mm, but may be narrower than 200 mm or broader than 300 mm.

According to aspects and embodiments of the technology disclosed, the at least one first cylindrical sector segment of the coil which are wrapped with the coil rotating at a lower angular velocity, or rotational speed, is provided with more layers of wrapping material compared to the at least one second cylindrical sector segment of the coil which is wrapped with the coil rotating at a higher angular velocity, or rotational speed.

According to aspects and embodiments of the technology disclosed, the entire cylindrical surface of the at least one first cylindrical sector segment of the coil which are wrapped with the coil rotating at a lower angular velocity, or rotational speed, is provided with multiple layers of wrapping material whereas the cylindrical surface of the at least one second cylindrical sector segment of the coil wrapped with the coil rotating at a higher angular velocity, or rotational speed, is partly provided with a single layer of wrapping material and partly with a double layer of wrapping material, for example stretch film.

According to aspects and embodiments of the technology disclosed, the entire cylindrical surface of the at least one first cylindrical sector segment of the coil which are wrapped with the coil rotating at a lower angular velocity, or rotational speed, is provided with at least five layers of wrapping material whereas the cylindrical surface of the at least one second cylindrical sector segment of the coil wrapped with the coil rotating at a higher angular velocity, or rotational speed, is partly provided with a single layer of wrapping material and partly with a double layer of wrapping material, for example stretch film.

According to aspects and embodiments of the technology disclosed, the entire cylindrical surface of the at least one first cylindrical sector segment of the coil which are wrapped with the coil rotating at a lower angular velocity, or rotational speed, is provided with at least ten layers of wrapping material whereas the cylindrical surface of the at least one second cylindrical sector segment of the coil wrapped with the coil rotating at a higher angular velocity, or rotational speed, is provided with less than three layers of wrapping material, for example stretch film.

In the example embodiment and when the robot arm interfaces with a robot tool, the robot tool may have two ends, each end being provided with a coupling tool piece configured to interface with a robot arm, and a roll holder shaft configured to hold a roll of packaging material, the roll holder shaft at one end being mounted between said ends and projecting substantially perpendicular to an axis extending between said ends. The method of the technology disclosed may then comprise wrapping the coil in a sequence of robot movements with handover of the robot tool with the roll of wrapping material from a first industrial robot to a second industrial robot and vice versa.

In embodiments, the technology disclosed relates to a system and method for wrapping a coil in a robot system comprising a control system, a cradle for carrying the coil, two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between said two ends and carrying a roll of wrapping material.

Critical to the success of the wrapping process is that the extended strip of wrapping material removed from the roll is maintained at and/or under a certain level of tension which may or may not be selected by the operator. The coupling robot piece of the robot arm may be controlled by actuating power, e.g. pneumatic power, and actuated by a Central Processing Unit (CPU) of the robot control system to close the coupling robot piece of the robot, for example a gripper or a master piece, configured to be able to grip or mate with a roll or at least one end of a robot tool.

The sequence of movements of the robot arm holding the robot tool carrying the roll of wrapping material are adapted to thereby allow the wrapping material to unravel smoothly at a controlled dispensing rate. A uniform tension may be imposed on the strip as the two robot arms pull roll back and forth around the coil. If the roll were allowed to "free-wheel" without any tension, the strip would flap about, crinkle, and end up being applied randomly to coil. Random application of the strip is not conducive to effective stretch wrapping of coil.

Since coil is typically being rotated slowly by rollers of the coil roller, each time the wrap cycle shown has been completed, a strip of wrapping material is applied to a segment of the annulus, i.e. a segment of the different surfaces of the coil. The width of the segment along the curved envelope surface is preferably well-defined by the movements and travel paths, in three-dimensional space, of the two robots and robot arms which are typically controlled by the robot control system and are different for each wrapping turn/pass/cycle/revolution around the annulus/coil. The width of the wrapping material on roll is typically reduced by the tension.

In some embodiments of the technology disclosed, the path of the strip around annulus is not strictly radial, however; rather, because the slow rotation of coil is not fully compensated for by method proposed herein, including positioning the rotation axis of the roll, or roll holder shaft, so that the rotation axis is directed at an inclined direction relative the direction of rotation of the coil or by a direction of travel along the curved envelope surface which is in an cylindrical direction related to the rotation axis of the coil, the path traverses coil at a slight angle.

The result is, that as the wrapping pass is repeated time and again with a slightly different travel path for the two robot arm in three-dimensional space for consecutive wrapping passes, the annulus is typically wrapped in a helical fashion until the entire outer surface of coil has been sealed, i.e., such that no surface area of coil is left exposed. To securely cover the entire surface of coil, an overlap of adjacent strips of wrapping material is necessary. The resulting amount of material overlap is at least partly determined by the angular velocity, or rotational speed, of coil.

In aspects and embodiments of the technology, the resulting amount of material overlap is solely determined by the outer radius of the coil to be wrapped and the angular velocity, or rotational speed, of coil.

In aspects and embodiments of the technology, the robot arms travel on a constant path for each wrapping pass/turn and the resulting amount of material overlap is solely determined by the outer radius of the coil and the angular velocity of the coil rollers of the cradle which, in turn, determines the angular velocity, or rotational speed, of the coil. The coil rollers are typically controlled by the control system of the robot system.

In aspects and embodiments of the technology, the resulting amount of material overlap is, in addition to the outer radius of the coil and the angular velocity, or rotational speed, of coil, is also determined by at least one of changing positioning and travel paths of the robotic arms during the wrapping process and changing speed of the robot arms during the wrapping process.

In embodiments, the sequence of movements of the robot arm is controlled by a software program of the robot control system. Control data may then be transmitted from the robot control system to the robot to control the movements of the robot and the robot arm of the robot. In certain embodiments, the robot control system comprises pre-stored software program associated with a certain coil for controlling the sequence of movements for wrapping the individual coil with a wrapping material. In other embodiments, certain dimensions of the individual coil, e.g. the inner and/or outer radius of the coil, are first measured and the software program and/or the control data for the controlling the travel paths, speed and sequence of movements of the two robots and their respective robot arm(s) is selected or generated based on the measured dimensions of the coil.

According to embodiments of the technology disclosed, the travel path of the robotic arms traveling around the coil may be adjusted and adapted to the rotational travel distance for the application position on the envelope surface during a pass and the rotational speed of the coil to thereby minimize wrap time and reduce wear and tear.

In certain embodiments, the technology disclosed proposes the combination of adjusting the rotational speed of the coil, the position of the robot tool holding the roll and that the direction of travel for the robot tool holding the roll is at an angle relative a direction parallel to the rotational axis of the coil. The combination of position adjustment and angle for the direction of travel along the curved envelope surface may then be selected to be adapted to the rotational speed of the coil and may or may not be slightly different for each lap. In certain embodiments, the combination includes position adjustments between wrapping turns/windings for the entry/starting position of the robot tool along/on the edge to the curved envelope surface (outer edge to the cylindrical surface of the coil) and adjusting, by the control system, the rotational speed of the coil so that at least one first lower rotational speed used when wrapping said at least one first cylindrical sector segment is within the range of 70-90% (i.e. less reductions/adjustments of the rotational speed is needed) of a higher second rotational speed used for wrapping the at least one other second cylindrical sector of the coil. In certain embodiments, the vertical position adjustment (perpendicular to the rotational axis of the coil) and overlap along the curved envelope surface may be at least 20% of the width of the roll, e.g. between 20 and 45% of the width of the roll, and the direction of travel along the curved envelope surface is selected to be at an angle, e.g. constant angular direction, between 0.1-15 degrees relative a direction parallel to the rotational axis of the coil. The position adjustments performed before and after applying the wrapping material on the envelope surface and inclined direction of travel are carried out in order to achieve a more constant tension of the wrapping material and keep the wrapping material, e.g. stretch film, taut while being pulled along the curved envelope surface, thereby reducing the risk of creases being formed in the film applied on the curved envelope surface of the coil.

In embodiments, the roll holder shaft holding the roll is directed at an angle relative the direction of rotation of the coil during travel along the curved envelope surface. The shaft may then be tilted, by the robot arm currently holding the roll, relative the direction of rotation of the coil along the envelope surface. The tilting of the shaft is performed for each lap and before starting the sequence of robot movements for wrapping the curved envelope surface.

In embodiments, the method of the technology disclosed comprises:

wrapping the cylindrical surface, or curved envelope surface, of the coil by holding, by the respective first and second industrial robot, the longitudinal axis of the roll holder shaft at an angle which is inclined with respect to the direction of rotation of the coil along the curved envelope surface area.

In embodiments, the technology disclosed proposes a solution including a combination of position adjustment for the robot tool holding the roll before starting unfolding the wrapping material on the curved envelope surface and that the roll holder shaft is tilted relative the direction of rotation of the coil during travel along the curved envelope surface. In embodiments, the position adjustments and the tilt angle may be adapted to the current rotational speed of the coil. The combination of position and tilt adjustments is performed to achieve a more constant tension of the wrapping material and keep the wrapping material, e.g. stretch film, taut while being pulled along the curved envelope surface, thereby reducing the risk of creases being formed in the film applied on the curved envelope surface of the coil.

In certain embodiments of the technology disclosed, the direction of travel along the curved envelope surface is selected to be at a certain angle between 0.1-10 degrees relative to an axis direction parallel to the rotational axis and the tilt (during travel along the curved envelope surface) is selected to be at a certain angle between 2-15 degrees angle relative the direction of rotation of the coil. The tilt angle relative the direction of rotation of the coil may then be adapted to the rotational speed of the coil, and is carried out in order to achieve a more constant tension of the wrapping material and keep the wrapping material, e.g. stretch film, taut while being pulled along the curved envelope surface, thereby reducing the risk of creases being formed in the film applied on the curved envelope surface of the coil.

In embodiments and by adapting the travel path to the rotational speed of the coil and by adapting at least one of the tilting angle of the roll holder shaft relative the direction of rotation of the coil along the envelope surface and the vertical position of the roll before beginning the wrapping of the curved envelope surface, a relatively constant tension on the wrapping material may be achieved to keep the wrapping material, e.g. stretch film, taut while being pulled along the curved envelope surface, thereby reducing the risk of creases being formed in the film applied on the curved envelope surface of the coil.

According to embodiments of the technology disclosed, a first handover phase takes place in a hollow cylindrical center core of the coil in a direction of travel for the respective robot holding the robot tool before and after the first handover in a same first plane which is substantially parallel to the rotational axis of the coil. A second handover phase takes place along an envelope surface of the coil in a second plane which is a different plane from the first plane.

The first and second industrial robot may then both be configured to receive instructions from the control system which cause the robot arm of the respective robot to move in the same horizontal plane during the first handover phase taking place in the hollow cylindrical center core of the coil.

In embodiments, the first and second industrial robot are both configured to receive instructions from the robot control system which cause the robot arm of the respective robot to hold the robot tool so that the roller holder shaft of the robot tool is directed substantially parallel to the rotational axis of the coil and substantially perpendicular to the gravitational axis along the path of travel for the two robot arms inside the hollow cylindrical center core of the coil.

The technology disclosed may also relate to a robot tool for coil packaging, comprising two ends, each end being provided with a coupling tool piece configured to interface with a robot arm;

a roll holder shaft configured to hold a roll of wrapping material, the holder shaft at one end being mounted substantially midway between said ends and projecting substantially perpendicular to an axis extending between said ends.

The robot tool may then comprise a carrier piece where the coupling tool pieces are each mounted at the respective ends of said carrier piece. The coupling tool pieces may be configured to be able to convey actuating power from a power supply line of a robot.

The robot tool may comprise a coupling in the form of a robot tool changer with the coupling tool piece configured to be able to mate with a coupling master piece of said tool changer mounted on a robot arm. The roll holder shaft of the robot tool may further comprise a roll fixture configured to releasably fix a roll of wrapping material to the roll holder shaft.

A portion of the roll holder shaft may be configured to be radially expandable to enable a roll fixture to releasably fix a roll of wrapping material to the roll holder shaft. The robot tool may further comprise at least one motor configured to drive, prevent and/or brake rotation of the roll holder shaft.

In embodiments, the technology disclosed may also relate to a robot tool for coil wrapping, comprising a carrier piece having two opposing ends, each end being provided with a tool piece of a robot tool changer configured to interface by mating with a corresponding master piece of a tool changer of a robot arm;

a roll holder shaft configured to hold a roll of wrapping material, the holder shaft at one end being mounted on said carrier piece substantially midway between said opposing ends and projecting substantially perpendicular to an axis extending between said opposing ends;

wherein:

the tool changers are configured to be able to convey actuating pneumatic power from a pneumatic power supply line of a robot when mated;

wherein a portion of the roll holder shaft is configured to be radially expandable by said pneumatic power to enable a roll fixture to releasably fix a roll of wrapping material to said roll holder shaft;

at least one pneumatic motor is mounted on the carrier piece, coupled to said roll holder shaft and configured to drive, prevent and/or brake rotation of said roll holder shaft by said pneumatic power.

In embodiments, the technology disclosed may relate to a robot system for coil packaging, comprising:

two industrial robots, each robot being provided with a robot arm having a coupling robot piece configured to interface with a robot tool;

a robot tool, the robot tool having two ends, each end being provided with a coupling tool piece configured to interface with a said robot arm, and a roll holder shaft configured to hold a roll of packaging material, the roll holder shaft at one end being mounted substantially midway between said ends and projecting substantially perpendicular to an axis extending between said ends.

In embodiments, the robot system may further comprise a control system configured to control the movement of the robots in relation to a coil positioned on a coil roller for being packaged with a wrapping material. The robot control system may comprise input/output interfaces configured to be communicatively coupled to the industrial robots, to one or more coil rollers, and/or to a human/machine interface for example in the form of a GUI generating a dashboard.

The robot arm may be configured as an elongate beam having the coupling robot piece mounted at the end of the beam.

The coupling robot pieces may be configured to be able to convey actuating power from a power supply line of any of the robots.

The coupling between said robots and said robot tool may be in the form of a robot tool changer with the coupling tool pieces of the robot tool configured to be able to mate with coupling master piece mounted on each robot arm.

The robot arms may comprise a wrapping material clamp configured to hold a strip of wrapping material, preferably mounted close to the distal end of the robot arm.

In certain embodiments, the robot system may further comprise:

a robot jig having a first and a second intersecting leg;

a first leg of the robot jig being configured with a first and a second robot base mounts placed apart on the first leg;

a second leg of the robot jig being configured with a first coil roller abutment placed at an end of the second leg.

The robot system may further comprise a first coil roller configured to give a coil placed in the first coil roller a rotating movement.

The robot jig may at its second leg further comprise a second coil roller abutment placed at the other end of the second leg.

The robot system may further comprise a second coil roller configured to give a coil placed in the second coil roller a rotating movement.

The robot system may further comprise a wrapping material clamping station placed substantially midway between said robots, said wrapping material clamping station being provided with a wrapping material clamp configured to hold a strip of wrapping material.

The robot system may include a wrapping material clamping station is placed substantially at the intersection of said first and second legs of the robot jig substantially midway between said robot base mounts, said wrapping material clamping station being provided with a wrapping material clamp configured to hold a strip of wrapping material.

The robot system may further comprise a roll magazine for storing a plurality of rolls of wrapping material available to one or more of the robots, the roll magazine being configured with a roll place and an associated wrapping material clamp for each roll of wrapping material, said wrapping material clamps being configured to hold a strip of wrapping material.

The robot system may further comprise a measuring system configured to measure the position and dimensions of a coil positioned on a coil roller for being packaged with a wrapping material, e.g. measure the outer and inner radius of the coil which may be used for determining the travel path for the robots and robot arm holding the roll with wrapping material. By measuring dimensions and taking into the rotational speed of the coil, the overlap for successive wrapping passes along the curved envelope surface of the coil may be determined by the determined travel path for each wrapping pass/turn.

The measuring system may comprise one or more laser measuring tools, for example mounted on one of or both robot arms.

In embodiments, the technology disclosed relates to a robot jig for coil packaging, comprising a first and a second intersecting legs;

wherein a first leg of the robot jig being configured with a first and a second robot base mounts placed apart on said first leg;

a second leg of the robot jig being configured with a first coil roller abutment placed at an end of said second leg.

The robot jig may further comprise a wrapping material clamping station placed substantially at the intersection of said first and second legs of the robot jig substantially midway between said robot base mounts, the wrapping material clamping station being provided with a wrapping material clamp configured to hold a strip of wrapping material.

The robot jig may further comprise a roll magazine for storing a plurality of rolls of wrapping material available to one or more of the robots, the roll magazine being configured with a roll place and an associated wrapping material clamp for each roll of wrapping material, said wrapping material clamps being configured to hold a strip of wrapping material.

In different embodiments, the method of coil packaging in a robot system may comprise a selection of:

placing a coil of sheet metal on a coil roller associated with a robot system for coil packaging;

measuring the position of the coil in relation to the industrial robots;

measuring the dimensions of the coil;

attaching a first turn of wrapping material rolled off from a roll of wrapping material attached to a robot tool;

wrapping the coil in a sequence of robot movements with handover of the robot tool with the roll of wrapping material from a first industrial robot to a second industrial robot; wherein a first handover phase takes place in a hollow cylindrical center core if the coil and a second handover phase takes place along an envelope surface of the coil, and wherein the angular velocity of the coil is adjusted and changed during the wrapping by the control system sending instructions to control the angular velocity of at least one coil roller imparting a rotational motion to the coil;

finishing the wrapping by clamping a strip of the wrapping material and cutting the strip of wrapping material.

In embodiments, this disclosure describes methods, a robot system and an apparatus for wrapping all exposed surfaces of a large annular coil, including its hollow cylindrical core, in a number of wrapping cycles/laps/passes to prevent contamination and to prepare it for shipping. A pair of parallel robotic arms hand off or transfer a roll of wrapping material, such as a plastic stretch film, from a gripper on one arm to a gripper on the other arm. The arms travel around both ends of the coil, handing off the roll back and forth along the curved envelop surface of the coil and in the center of its hollow core.

In different embodiments, the robot system typically comprises a drive unit and a robot control system comprising a program storage for storing control programs including movement instructions for the two robots and the robot arms, a program executor adapted to execute the movement instructions for the robots, and a motion planner adapted to determine how the robots should move around the coil for each successive wrapping turn in order to be able to execute the movement instructions for the robots and on the basis thereon generate control signals to the drive unit.

The program storage is typically adapted to store control programs including movement instructions for the robot and the robot arms. The program executor is adapted to execute the movement instructions and the motion planner is adapted to determine, for each individual wrapping turn, how the two robot/robot arms should move around the coil in order to be able to execute the movement instructions.

In embodiments, the technology disclosed relates to a robot system device for wrapping a coil, comprising:

a robot control system, comprising:

at least one processor, and at least one memory including computer program instructions, the at least one memory and the computer program instructions configured, with the processor, to cause the robot system to:

determine an individual travel path for each successive wrapping turn for the movements of the robots/robot arms in three-dimensional space along the surfaces of the coil based on received, modelled and/or measured dimensions and/or positions of the coil, the rotational speed of the coil and/or a determined/desired overlap between successive wrapping turns/passes on the curved envelope surface of the coil;

cause the robots and/or robot arms to move along the surfaces of the coil based on the travel path for each successive wrapping turn.

In embodiments, the at least one memory and the computer program instructions are further configured, with the processor, to cause the robot control system to:

obtain, feedback information, such as sensor data, concerning the overlap between successive wrapping passes along the cylindrical surface;

determine a deviation based on the obtained feedback information; and determine a real-time adjustment of the angular velocity of the coil and/or the coil rollers conveying a rotational motion to the coil based on the deviation.

In embodiments, wherein the at least one memory and the computer program instructions are further configured, with the processor, to cause the robot control system to:

determine whether a deviation of the overlap is greater than a predetermined threshold deviation; and in response to the deviation is greater than the predetermined threshold deviation, determine to adjust the angular velocity of the coil and/or the coil rollers conveying a rotational motion to the coil.

Embodiments described herein are generally applicable in apparatus, system and methods for packaging articles with packaging material. The expressions packaging and packaging material are herein also synonymously used with the expressions wrapping and wrapping material since an article or object that is packaged by means of the disclosed embodiments is wrapped by relative movements of robot arms and/or of the article.

More specific embodiments described herein relate to a robot tool, system and method for packaging annular articles, such as coils of sheet metal, that are rotated while being packaged with a wrapping material. Such embodiments, preferably configured for use in a coil wrapping production line, is shown schematically in FIG. 1A to FIG. 1E.

Embodiments of a Robot Tool

Figure 1B:
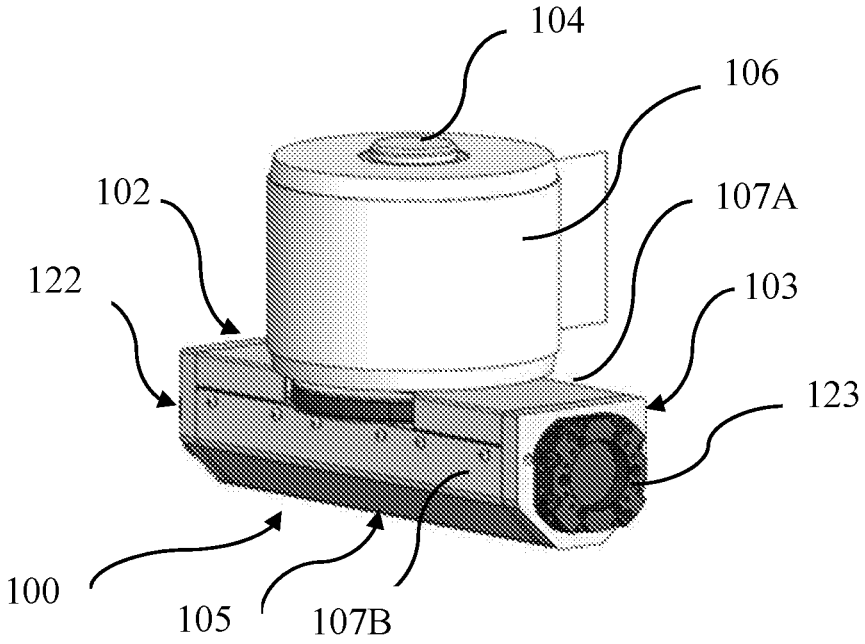
FIG. 1B illustrates schematically the embodiment of the robot tool shown in FIG. 1A with a roll of wrapping material placed on the roll holder shaft.
Figure 1C:
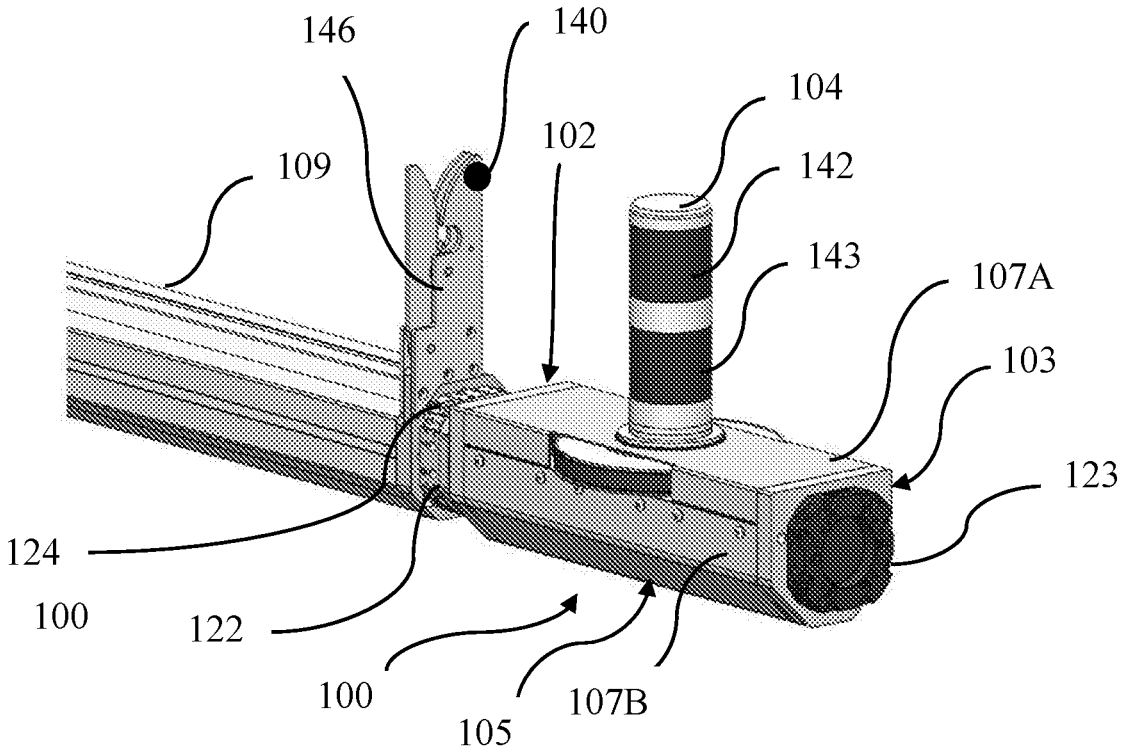
FIG. 1C illustrates schematically the embodiment of the robot tool shown in FIG. 1A and FIG. 1B coupled to a robot arm at one side or end of the robot tool.
Figure 1D:
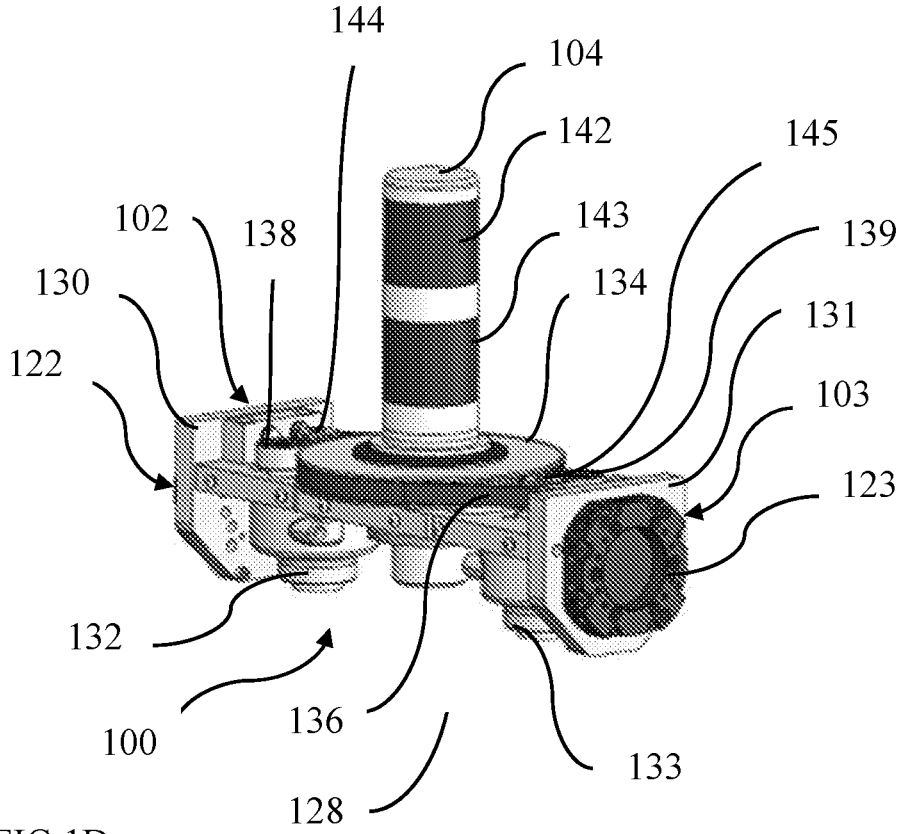
FIG. 1D illustrates schematically an embodiment of the robot tool shown in FIG. 1A-FIG. 1D in more detail.

FIG. 1A to FIG. 1E illustrate schematically an embodiment of a robot tool 100 provided with a roll holder shaft 104 for holding a roll 106 of wrapping material and being configured for handover between robot arms 108,109 of coordinated industrial robots 112,113 (Cf. FIG. 1D).

General embodiments of a robot tool 100 for coil packaging, comprises two, preferably opposing, ends 102,103 with each end being provided with a coupling tool piece 122,123 configured to interface with a robot arm 108,109. This embodiment further comprises a roll holder shaft 104 configured to hold a roll 106 of packaging material, the holder shaft 104 at one end being rotatably mounted substantially midway between said, preferably opposing, ends 102,103 and projecting substantially perpendicular to an axis extending between said, preferably opposing, ends 102,103. The robot tool 100 may be provided with a housing 105 comprising one or more cover plates 107A, 107B.

In embodiments, the two ends are substantially mutually opposing ends, and the coupling tool pieces are preferably mounted on the respective ends such that the robot tool is substantially symmetrical. In certain embodiments, the holder shaft may be rotatably mounted substantially midway between said ends and projecting substantially perpendicular to an axis extending between said ends. The robot tool may then be generally T-shaped and have symmetric design to allow for an efficient operation and handling by two industrial robots.

In other embodiments of the robot tool, the coupling tool pieces may be arranged in other configurations, e.g. the holder shaft may be rotatably mounted offset from the midway point between the opposing ends and/or be projecting at an angle different from perpendicular to an axis extending between the two ends. As an example configuration of a robot tool according to certain aspects of the technology disclosed, the holder shaft may be projecting at a certain angle within an angle range of 75-88 degrees relative to an axis extending between the two opposing ends.

The angle for the projecting holder shaft relative the extending axis between the opposing ends may then be selected and designed for being used for wrapping a coil having a certain outer radius. As an example, the angle for the projecting holder shaft holding the wrapping material relative the extending axis may be designed for a coil having a certain outer radius and which is rotated about its rotational axis, e.g. by drive rollers of a cradle carrying the coil.

In different embodiments of the technology disclosed, the angular velocity, or rotational speed, of the annular object, or coil, varies with the angular velocity rotational speed of the at least drive roller, or coil roller in that the at least one drive roller conveys a rotational motion to the coil during the wrapping of the curved envelope surface of the coil with overlapping strips of wrapping material, e.g. overlapping strips of plastic stretch film. Thus, a certain angular velocity of the at least one drive roller, which may be controlled by instructions from the control system, corresponds to a certain angular velocity of the coil in that the at least one drive roller conveys a certain rotational motion to the coil.

FIG. 1B illustrates schematically the embodiment of the robot tool shown in FIG. 1A with a roll 106 of wrapping material placed on the roll holder shaft 104.

FIG. 1C illustrates schematically the embodiment of the robot tool shown in FIG. 1A and FIG. 1B coupled to a robot arm 108,109 (109 shown in FIG. 1C) at one side or end 102 of the robot tool 100. Embodiments of the robot arm 108,109 is provided with a coupling robot piece 124,125 for example a gripper or a master piece of a tool changer, configured to be able to grip or mate with a coupling tool piece 122,123 of the robot tool 100. As shown in the embodiment of FIG. 1C, a robot arm 109 is coupled to the robot tool 100 via a coupling robot piece 124 that is mated with the robot tool piece 122 to the left in FIG. 1C at one end 102. At another end 103 of the robot tool 100, to the right in FIG. 1C, a second coupling tool piece 123 is available for coupling to another robot arm 108 not shown in FIG. 1C.

FIG. 1D illustrates schematically an embodiment of the robot tool shown in FIG. 1A-FIG. 1C in more detail and without the cover of the housing 105 shown in FIG. 1A to FIG. 1C. In the embodiment of FIG. 1D, the robot tool 100 comprises a carrier piece 128 with an end piece 130,131 attached to the carrier piece 128 at the respective ends 102,103 of the robot tool 100. Coupling tool pieces 122, 123 are attached to the end pieces 130,131 at the respective, preferably opposing, ends 102,103 of said carrier piece 128. Thus, in embodiments there is comprised a carrier piece 128 where the coupling tool pieces 122,123 are each mounted at the respective ends of the carrier piece 128.

The coupling tool pieces 122,123 are configured to be able to convey actuating power from a power supply line of a robot, such as an industrial robot. The actuating power may in different embodiments for example be in the form of pneumatic power, hydraulic power or electric power. In embodiments as illustrated FIG. 1A to FIG. 1D, the actuating power is preferably pneumatic power. The coupling may typically be configured to be couplable by a bayonet coupling and/or locked in position by means of actuation power controlled by the respective robots.

In embodiments the coupling configured for interfacing between the industrial robots and the robot tool is configured in the form of a robot tool changer with the coupling tool piece 122,123 configured to be able to mate with a coupling master piece 124, 125 of said tool changer mounted on a respective robot arm.

In embodiments of the robot tool, and shown in FIG. 1A-FIG. 1D, the roll holder shaft 104 further comprises a roll fixture 142,143 configured to releasably fix a roll of wrapping material to said roll holder shaft. For example, a portion 142,143 of the roll holder shaft is configured to be radially expandable to enable a roll fixture to releasably fix a roll of wrapping material to said roll holder shaft. In embodiments, this is implemented as one or more inflatable bladders 142,143 that are controllably inflatable by means of pneumatic power, i.e. pressurized air, conveyed from the respective robots via the coupling interfaces. In other embodiments, the roll fixture 142,143 is actuatable for example by electric or hydraulic power.

Figure 1E:
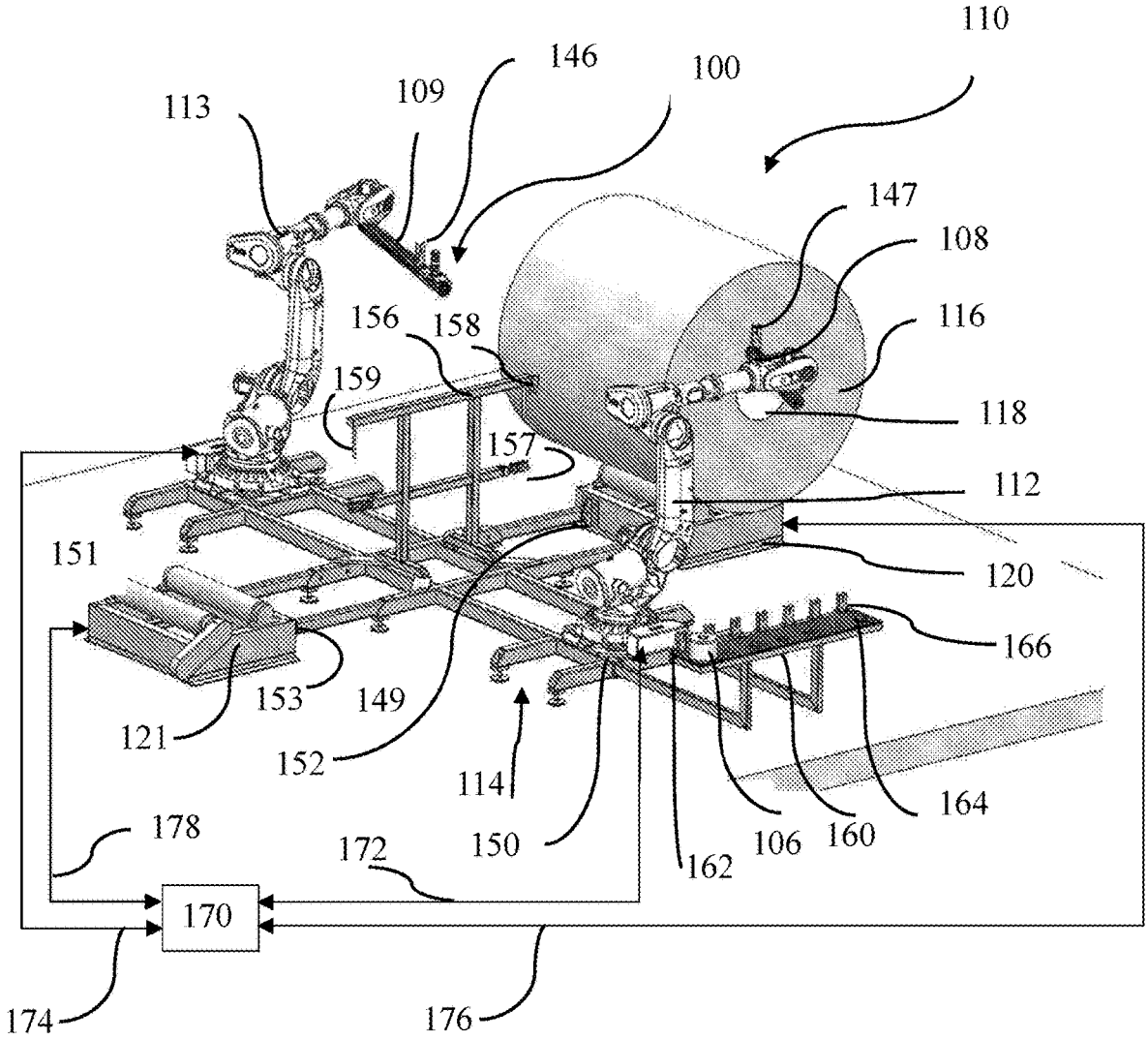
FIG. 1E illustrates schematically an embodiment of a robot system comprising an embodiment of the robot tool shown in FIG. 1A to FIG. 1D and configured to wrap a rotating annular object, e.g. a coil of sheet metal.

Embodiments of the robot tool 100 further comprises at least one motor 132,133 configured to drive, prevent and/or brake rotation of the roll holder shaft. As shown in the embodiment of FIG. 1E, a pneumatic motor 132,133 is mounted on the carrier piece 128 at each side of the roll holder shaft 104. The roll holder shaft 104 is provided with a sprocket 134 configured to be engaged by a toothed belt 136. The toothed belt 136 is also engaged with sprockets 144,145 coupled to the respective motor 132,133 and is biased by tension wheels 138,139 preferably mounted as backside idlers on the toothed belt 136.

The embodiments of the robot tool shown in FIG. 1A-FIG. 1D have a basically symmetrical configuration. When a first robot arm is coupled to the robot tool 100 at, for example, the right side of the tool (in FIG. 1D) to the coupling tool piece 123, the motor 133 and the roll fixture 142,143 are actuated by means of pneumatic power, i.e. pressurized air, supplied from the first robot arm (or first robot) via the coupling tool piece 123. When a second robot arm is coupled to the robot tool at the left side of the tool to the coupling tool piece 122, the motor 132 and the roll fixture 142,143 are actuated by means of pneumatic power from the second robot arm via the coupling tool piece 122. During a phase, typically a handover phase, when the first robot and the second robot are both engaged with the robot tool, the motors 132, 133 and roll fixture 142,143 are simultaneously actuated or actuatable by the respective first and second robots. In other embodiments, the motors 132, 133 and/or the roll fixture 142,143 are actuatable for example by electric or hydraulic power.

An embodiment of a robot tool for coil wrapping, comprising:

a carrier piece having two opposing ends, each end being provided with a tool piece of a robot tool changer configured to interface by mating with a corresponding master piece of a tool changer of a robot arm;

a roll holder shaft configured to hold a roll of wrapping material, the holder shaft at one end being mounted on said carrier piece between said opposing ends and projecting substantially perpendicular to an axis extending between said opposing ends.

In embodiments, the tool changers of the above robot tool are configured to be able to convey actuating pneumatic power from a pneumatic power supply line of a robot when mated;

wherein a portion of the roll holder shaft is configured to be radially expandable by said pneumatic power to enable a roll fixture to releasably fix a roll of wrapping material to said roll holder shaft;

at least one pneumatic motor is mounted on the carrier piece, coupled to said roll holder shaft and configured to drive, prevent and/or brake rotation of said roll holder shaft by said pneumatic power.

In embodiments, the technology disclosed relates to a robot tool for coil wrapping, comprising:

a carrier piece having two opposing ends, each end being provided with a tool piece of a robot tool changer configured to interface by mating with a corresponding master piece of a tool changer of a robot arm;

a roll holder shaft configured to hold a roll of wrapping material, the holder shaft at one end being mounted/positioned on said carrier piece substantially midway between said opposing ends and projecting substantially perpendicular to an axis extending between said opposing ends;

wherein:

the tool changers are configured to be able to convey actuating pneumatic power from a pneumatic power supply line of a robot when mated;

wherein a portion of the roll holder shaft is configured to be radially expandable by said pneumatic power to enable a roll fixture to releasably fix a roll of wrapping material to said roll holder shaft;

at least one pneumatic motor is mounted on the carrier piece, coupled to said roll holder shaft and configured to drive, prevent and/or brake rotation of said roll holder shaft by said pneumatic power.

In embodiments, the technology disclosed relates to a robot tool for coil wrapping, comprising:

a carrier piece having two opposing ends, each end being provided with a tool piece of a robot tool changer configured to interface by mating with a corresponding master piece of a tool changer of a robot arm;

a roll holder shaft configured to hold a roll of wrapping material, the holder shaft at one end being mounted/positioned on said carrier piece between said opposing ends, e.g. substantially midway between said opposing ends, and projecting at a certain angle within an angle range of 75-88 degrees relative to an axis extending between the two opposing ends.

In certain embodiments, the tool changers of the robot tool having a holder shaft projecting within an angle range of 75-88 degrees relative to an axis extending between the two opposing ends are configured to be able to convey actuating pneumatic power from a pneumatic power supply line of a robot when mated;

wherein a portion of the roll holder shaft is configured to be radially expandable by said pneumatic power to enable a roll fixture to releasably fix a roll of wrapping material to said roll holder shaft;

at least one pneumatic motor is mounted on the carrier piece, coupled to said roll holder shaft and configured to drive, prevent and/or brake rotation of said roll holder shaft by said pneumatic power.

Embodiments of a Robot System

FIG. 1E illustrates schematically an overview of an embodiment of a robot system 110, in this example comprising an embodiment of the robot tool shown in FIG. 1A to FIG. 1D, and configured to wrap a rotating annular object, e.g. a coil of sheet metal 116. Embodiments of the robot system 110 may be configured to operate with other embodiments of the robot tool.

In embodiments, the technology disclosed relates to a robot system for coil packaging, comprising:

a. two industrial robots 112,113, each robot being provided with a robot arm 108,109 having a coupling robot piece 124,125 (125 not shown in FIGs) configured to interface with a robot tool, and b. a robot tool 100.

The robot tool 100 typically have two ends 102,103, where each end may be provided with a coupling tool piece 122,123 configured to interface with a said robot arm 108,109, and a roll holder shaft 104 configured to hold a roll of packaging material 106. The roll holder shaft 104 at one end being mounted between said ends 102,103 and projecting at certain angle which is substantially perpendicular to an axis extending between said ends 102,103, or within an angle range of 75-88 degrees relative the axis extending between said ends 102,103.

In the embodiment illustrated in FIG. 1A to 1D, the roll holder shaft 104 is mounted substantially midway between said opposing ends 102,103 and is projecting substantially perpendicular to an axis extending between said ends 102, 103. In embodiments of the robot system, the robot arm 108,109 is configured as an elongate beam having said coupling robot piece 124,125 mounted at the end of the beam. The coupling robot pieces 124, 125 are configured to be able to convey actuating power from a power supply line of any of said robots. As mentioned above, the actuating power is in preferred embodiments compressed air in a pneumatic system. In other embodiments, the actuating power may for example be electric power or hydraulic power. In embodiments, the coupling between said robots 112,113 and said robot tool 100 is in the form of a robot tool changer with the coupling tool pieces 122,123 of the robot tool 100 configured to be able to mate with coupling master piece 124,125 mounted on each robot arm 108,109.

In embodiments, the robot is configured to reduce or shut off the actuating power, e.g. pneumatic power or hydraulic power, used for controlling the coupling robot piece 124, 125 holding the robot tool before the handover phase at a certain distance from the position of handover, i.e. when the robot tool is still gripped or held by only the robot handing over the robot tool to another robot. The distance from the position of the handover when the actuating power for controlling coupling robot piece 124, 125 is reduced or turned off may typically be at a distance within a distance interval of 20-200 mm from the position of handover, e.g. within a distance interval of 20-200 mm from a position for each portion of the robot tool when the robot tool is first held by both robots. In certain embodiments, the robot control system 170 of the robot system, which is configured to control the movement of the robots 112,113 in relation to a coil 116, may then be further configured to also control the reduction or shutting off of the actuating power at a certain distance from the handover position. Shutting off the actuating power of the robot arm holding the robot tool at a distance from the handover position provides for faster handover and a faster process for wrapping the coil.

In an example embodiment where the actuating power for controlling the coupling robot piece 124, 125 is completely switched off before handover, the robot tool is held by and locked to the coupling robot piece 124, 125 solely by mechanical force, e.g. solely by mechanical spring tension.

The provision of a robot system where the coupling robot piece 124, 125 of the robot handing over the tool is controlled by reducing or shutting off the actuating power before handover may enable a flying handover of the robot tool, i.e. where the robot arms of the respective robot is in motion during the whole handover, or that the time period at the handover position when the two robots arms are both stationary, i.e. are not moving, may be significantly reduced, thereby providing for a shorter (faster) handover, a shorter (faster) wrapping cycle and improved productivity. As shown in FIG. 1C, the robot arms 108,109 each comprises a wrapping material clamp 146,147 configured to hold a strip of wrapping material, preferably mounted close to the distal end of said robot arm 108,109.

Embodiments of the robot system 110, further comprises: a robot jig 114 having a first 148 and a second 149 intersecting leg. A first leg 148 of the robot jig 114 is configured with a first 150 and a second 151 robot base mounts placed apart on said first leg 148. A second leg 149 of the robot jig 114 is configured with a first coil roller abutment 152 placed at an end of said second leg 149.

Embodiments of the robot system further comprises a first coil roller 120 configured to give a coil 116 placed in said first coil roller 120 a rotating movement. In embodiments configured with two coil stations, and as shown in FIG. 1E, the robot jig 114 at its second leg 149 further comprises a second coil roller abutment 153 placed at the other end of said second leg 149. Such embodiments further comprise a second coil roller 121 configured to give a coil (not shown) placed in said second coil roller 121 a rotating movement.

The robot jig 114 in the shown embodiments is thus configured with two robot base mounts 150,151 placed apart on a first leg of the cross geometry as well as a first and a second coil roller abutment 152,153 placed apart on a second leg of the cross geometry. A first 112 and a second 113 industrial robots are mounted on the respective robot base mounts 150,151. A first 120 and a second 121 coil roller are placed to the respective coil roller abutments 152,153. Such coil rollers 120,121 are per se known and typically comprises a cradle of two rollers that are actuatable to give a coil placed in the cradle a rotating movement about the rotational axis of the coil. In embodiments and when placed in the cradle, the rotational axis of the coil is typically perpendicular to the gravitational axis. An annular article schematically illustrating a coil of sheet metal 116 with a hollow cylindrical center core 118 is placed on the first coil roller 120. Each of the industrial robots 112, 113 comprises a robot arm 108,109 configured to be couplable to a robot tool 100 at each end.

Coils of sheet metal appear in different sizes. A large coil may have a length of 2300 mm, normal sizes are in the range of 1200 to 1500 mm length and down to a minimum that may be 800 mm length. The hollow center core often has an inner diameter of 508 or 610 mm, and there are diameters as small as 420 mm. The outer diameter of a coil may vary from for example 600 mm to 2.5 meters.

In the embodiment shown in FIG. 1E, the robot jig 114 is configured with a general cross geometry of substantially perpendicular legs with one or more bars, i.e. the bars making up the legs and thus the one or more bars intersecting at substantially right angles. Other intersecting angles may be configured with adapted configurations of the robots, their range and their movements. In the shown embodiment visible in FIG. 1E, each leg comprises two parallel bars.

In embodiments, the two industrial robots 112,113 of the robot system and the robots of the technology disclosed may further be configured to tilt the longitudinal axis of the roll 106, or roll holder shaft 104, and then keep the longitudinal axis of the roll, and/or roll holder shaft 104, at a certain angle with respect to the direction of rotation along the envelope surface so that the longitudinal axis of the roll 106 and/or roll holder shaft 104 is kept tilted at an angle relative the direction of rotation of the curved envelope surface area where the wrapping material, e.g. stretch film, is transferred from the roll holder shaft to the envelope surface and applied to the coil.

The cradle carrying the coil may comprise means, e.g. at least one drive roller, configured to rotate the coil about its rotational axis at a certain rotational speed. The angle of the longitudinal axis of the roll 106, and/or roll holder shaft 104, relative the direction of rotation may then be further selected, adapted and/or optimized with respect to the rotational speed of the coil, e.g. adapted to an estimated velocity for the outer radius of the coil and/or the velocity of the envelope surface where the wrapping material is applied to the coil. In embodiments, the at least one drive roller may rotate the coil about its rotational axis at a constant rotational speed throughout a certain wrapping pass, e.g. including the handover phase along the envelope surface, but the rotational speed varies between at least some of the individual wrapping passes.

Embodiments of the robot system 110, further comprises a wrapping material clamping station 156 placed substantially midway between said robots 112,113, said wrapping material clamping station 156 is provided with one or more wrapping material clamps 157,158 configured to hold a strip of wrapping material. The wrapping material clamping station 156 is preferably placed substantially at the intersection of said first and second legs 148,149 of the robot jig 114 substantially midway between said robot base mounts 150,151, said wrapping material clamping station 156 being provided with one or more wrapping material clamps 157, 158 configured to hold a strip of wrapping material.

In embodiments, the robot system 110 further comprises a roll magazine 160 for storing a plurality of rolls 106 of wrapping material available to one or more of the robots. The roll magazine 160 is configured with one or more roll places 164 and an associated wrapping material clamp 162,166 for each roll of wrapping material, said wrapping material clamps 162,166 being configured to hold a strip of wrapping material.

Embodiments of the robot system 110 further comprises a measuring system configured to measure the position and dimensions of a coil 116 positioned on a coil roller 120,121 for being packaged with wrapping material. In embodiments, the measuring system comprises one or more laser measuring tools 140, for example mounted on one of or both robot arms 108,109 (Cf. FIG. 1C). With such a laser measuring tool mounted on the robot arm, it is preferable that it is positioned such that is has an optical line that is unobstructed by a roll of wrapping material attached to the robot tool. When measuring the position and dimensions, the robot system is configured to find the center of the coil, follow the contours and calculate the position and the dimensions.

The robot system 110, in embodiments, further comprises a robot control system 170 configured to control the movement of the robots 112,113 in relation to a coil 116 positioned on a coil roller 120,121 in the robot system for being packaged with a wrapping material. The robot control system comprises input/output interfaces configured to be communicatively couplable to the industrial robots 112,113, to one or more coil rollers 120,121, and/or to a human/machine interface (not shown) for example in the form of a GUI generating a dashboard.

Embodiments of Method for Coil Wrapping

In an overview of operation during a wrapping sequence, a first robot 112 with a first robot arm 108 coupled to a first side of the robot tool 100 carries the robot tool 100 loaded with a roll 106 of wrapping material, inserts the robot tool into the cylindrical center core 118 to a position where the second robot with the second robot arm 109 couples to the second side of the robot tool 100. The robot tool 100 is handed over to the second robot 112 which in its turn transports the robot tool 100 out of the center core 118 along the base of the cylindrical coil 116 and along its envelope surface all while the wrapping material is unfolding or reeling up from the wrapping material roll 106. The robot tool 100 is then handed over from the second robot 113 back to the first robot 112, and the cycle is repeated. During the wrapping cycle the coil roller 120 is rolled in a tempo coordinated with the movements of the robots to achieve an overlapping wrapping of the coil 116, i.e. a portion of the strip of wrapping material is overlapped with a previous strip of wrapping material at least on the curved envelope surface of the coil 116. To securely cover the entire surface of the coil 116, e.g. to securely cover at least the entire envelope surface of the coil 116, an overlap, e.g. predetermined overlap, of adjacent strips of wrapping material from consecutive wrapping cycles is achieved. Thus, the wrap overlaps at least on the cylindrical surface, or envelope surface, of the coil during each successive pass around the coil 116, thereby ensuring its sealed integrity.

In various embodiments, the at least one drive roller, or coil roller, of the cradle may be configured to rotate the coil so that the rotational speed of the coil varies over a wrapping pass/cycle and/or varies through the process of wrapping the coil.

The technical effects achieved by the embodiment of tilting the longitudinal axis of the roll holder shaft at an angle relative the direction of rotation of the coil include that a better controlled and more even and adequate tensioning of the film is achieved when transferring the film from the roller tool to the envelope surface of the coil, thereby reducing the risk of creases being formed in the stretch film applied on the envelope surface. A better controlled and more even and adequate tensioning of the stretch film when transferring the film from the roller tool to the envelope surface of the coil may also permit a more efficient wrapping of the envelope surface by enabling the use of a smaller overlap between consecutive strips of stretch film applied to the envelope surface during consecutive wrapping cycles, thereby reducing excessive usage of stretch film. A better controlled and more even and adequate tensioning of the film may also enable a faster movement of the robot arm holding the robot tool as the risk of creases formed in the film applied on the envelope surface is reduced, and thus, enable faster handovers and shorter (faster) wrapping cycles for improved productivity.

In embodiments, the direction of travel of the roll 106 and/or robot tool 104 along the envelope surface is substantially parallel with the rotational axis of the coil and the roll axis or roll holder shaft 104 of the robot tool is held by the respective robot at a certain angle with respect to the direction of rotation of the coil. In this embodiment, the respective robot holding the robot tool maintain the longitudinal axis of the roll holder shaft 104 at the substantially same angle with respect to the direction of rotation of the coil throughout the whole handover phase along the envelope surface.

In certain embodiments, the angle of the longitudinal axis of the roll 106 and/or the roll holder shaft 104 relative the direction of rotation of the coil may be adapted to and/or dependent on the rotational speed of the coil, e.g. adapted to a substantially constant rotational speed used during a certain wrapping pass. In certain embodiments, the selected inclination angle of the longitudinal axis of the roll holder shaft 104 relative the direction of rotation of the coil is within an angle range of 2 to 30 degrees, where the inclination angle may be adapted to and depend on the rotational speed of the coil and/or the direction of travel of the robot tool relative the direction of the rotational axis of the coil.

In embodiments, the longitudinal axis of the roll or roll holder shaft 104 is tilted, by the robot arm of the industrial robot holding the robot tool, to a desired inclination angle relative the direction of rotation of coil while holding the robot tool with the unfolding roll after the handover phase in the hollow cylindrical center core of the coil and before the robot tool reaches the envelope surface and the sequence of robot movements for transferring the film to the envelope surface of the coil begins. The longitudinal axis of the roll holder shaft may then be tilted relative the direction of rotation for the surface area on the envelope surface where the film is to be applied and while moving the robot tool along the end surface of the coil.

In embodiments, the robot system of the technology disclosed is configured to adjust both the vertical position and the lateral position of the robot tool after before reaching the envelope with the purpose of maintaining a more even tensioning in the film during the transferring of the film from the robot tool to the curved envelope surface.

Figure 2:
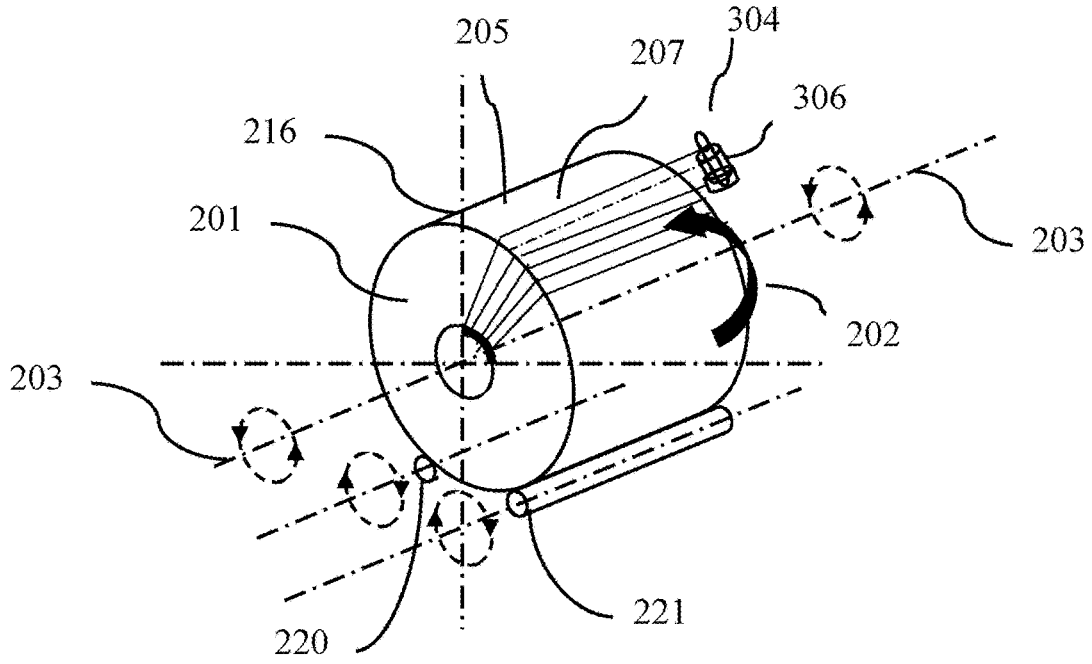
FIG. 2 illustrates an example embodiment of a system and method for wrapping a coil with an overlap between successive wraps.

FIG. 2 illustrates a coil 200 of sheet metal 216 having a first end surface 201 and a curved envelope surface 205. A pair of drive rollers 220, 221 give the coil 200 placed in the cradle (not shown) a rotating movement about the rotational axis 203 of the coil. A robot tool 304 holding a roll 306 of wrapping material travels along the first end surface 201, the second end surface 202 (hidden) and the curved envelope surface 205 of the coil 200 so that overlapping strips of wrapping material are applied to the surfaces of the coil 200.

Figure 3:
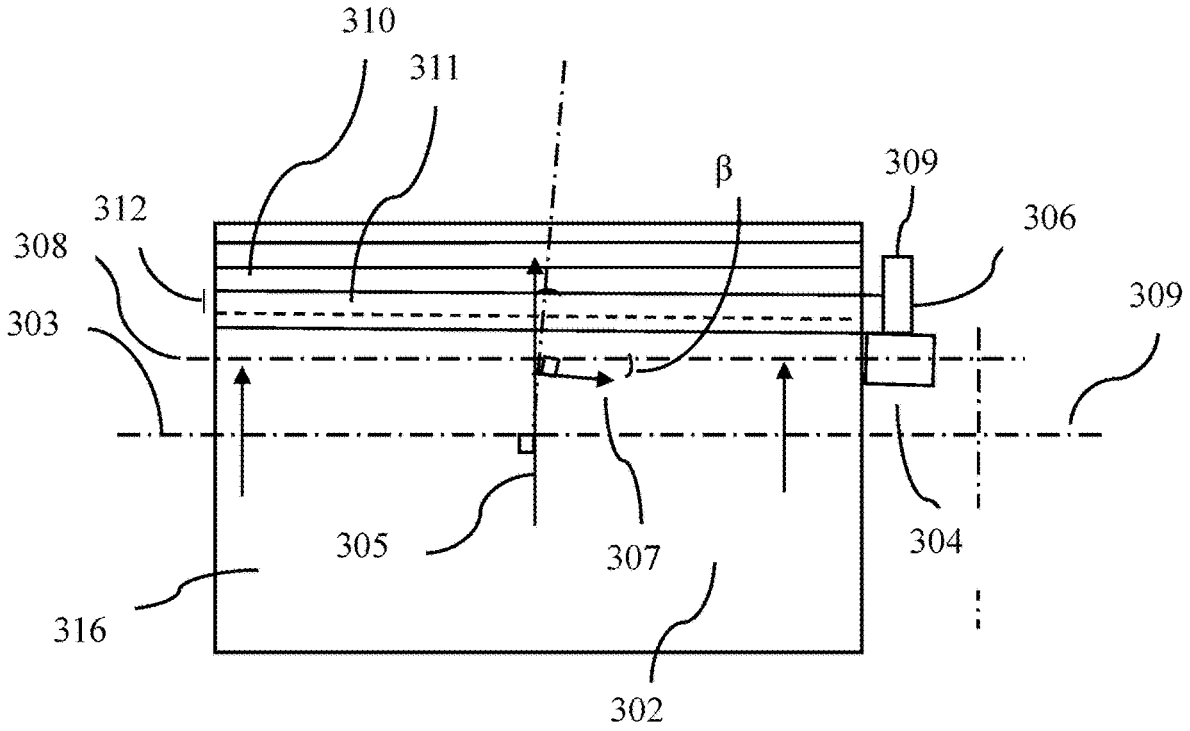
FIG. 3 illustrates an example embodiment of a system and method for wrapping a coil with an overlap between successive wraps.

FIG. 3 illustrates a coil of sheet metal 316 in rotating movement about its rotational axis 303 and during application of the wrapping material on a roll 306 to the curved envelope surface 302 of the coil 316 in successive wrapping passes and overlapping strips 310, 311 of the wrapping material. 312 shows the overlap between two successive wrapping passes. The roll 306 of wrapping material rotates about a roll holder shaft 309 of a robot tool 304 to unroll the wrapping material in a controlled manner.

As illustrated in FIG. 3, the roll of wrapping material is moved along the curved envelope surface essentially parallel with the rotational axis 303 of the coil while the coil is rotating at a certain angular velocity so that the direction of the application of the wrapping material to the coil 307 along the curved envelope surface is in a direction at an angle β relative an axis 308 along the curved envelope surface which is parallel with the rotational axis 303 of the coil.

In different embodiments of the technology disclosed, the roll of wrapping material is moved along the curved envelope surface essentially parallel with the rotational axis 303 of the coil while the coil is rotating at a certain angular velocity so that the direction of the application of the wrapping material to the cylindrical surface of the coil 307 by the respective robot and robot arm holding the roll along the curved envelope is at a direction β within the angle range of 0.1 to 5 degrees relative an axis 308 along the curved envelope surface which is parallel with the rotational axis 303 of the coil.

In the method of wrapping the coil, consecutive strips of wrapping material overlap which are applied on the curved envelope surface of the coil during consecutive laps overlap so that a section of the wrapping material of a subsequent strip partially overlaps the preceding strip, thereby producing a certain amount of overlap.

Embodiments of a method of coil packaging in a wrapping station with a robot system as described above, comprises a selection of:

Placing a coil of sheet metal on a coil roller associated with a robot system for coil packaging.

Typically, the coil of sheet metal is transported from the manufacturing line to the wrapping station by means of an overhead crane or other crane or fork-lift.

Measuring the position of the coil in relation to the industrial robots.

Once a coil is placed in the wrapping station and a wrapping operation is started, the position of the coil is measured by the measuring system. In embodiments, this is carried out by one or both robots scanning the contours of the coil by means of the laser measuring tool 140.

Measuring the dimensions of the coil.

In conjunction with the position measuring or as a separate phase the dimensions of the coil is measured. Similarly in embodiments, the dimension measuring is carried out by one or both robots scanning the contours of the coil by means of the laser measuring tool 140.

Attaching a first turn of wrapping material rolled off from a roll of wrapping material attached to a robot tool.

In order to fasten the first turn of wrapping material, an end strip of the wrapping material is fastened to one of the wrapping material clamps 157,158 on the wrapping material clamping station 156. With the end strip held in clamp, the first robot 112 holding the robot tool loaded with the roll of wrapping material moves the robot tool along the envelope surface of the coil, along the first side of the coil and into the hollow cylindrical center core of the coil all while the wrapping material unfolds or rolls off from the roll 106. Inside the center core, the second robot 113 with its robot arm couples to the robot tool in a first handover phase. The first robot releases the robot tool and moves back out of the hollow center core and up in front of the envelope surface of the coil to prepare for a second handover phase. Meanwhile, the second robot 113 now holding the robot tool with the roll of wrapping material moves out of the hollow center core, along the second side of the coil and along the envelope surface of the coil. The first robot 112 again engages and couples to the robot tool 100 and moves together with the second robot in a second handover phase until the second robot releases the robot tool 100. In this first fastening sequence, the second turn of wrapping material overlaps with the first turn and locks the wrapping material. The clamped end strip is then released from the wrapping material clamp.

The handover phases may for example last in the order of ½ to 5 seconds during a coordinated movement where the robot tool is displaced about 5 to 30 centimeters, preferably close to 15 cm.

Wrapping the coil in a sequence of robot movements with handover of the robot tool with the roll of wrapping material from the first industrial robot 112 to the second industrial robot 113; wherein a first handover phase takes place in the hollow cylindrical center core if the coil and a second handover phase takes place along an envelope surface of the coil.

The robots 112,113 continues the wrapping movement as described in the previous section. The coil roller maintains a rolling movement of the coil such that each turn of wrapping material on one hand partly overlap with the previous turn and on the other hand.

Finishing the wrapping by clamping a strip of the wrapping material and cutting the strip of wrapping material.

When the coil has been fully wrapped, a strip of the wrapping material is clamped in the clamping station 156 and the strip is cut. For the purpose of cutting the wrapping material, a strip of the wrapping material is turned around a shaft 159 at the clamping station 156, in order to keep track of where the wrapping material is in the robot space, and thereafter the strip is cut. Before cutting the strip of wrapping material, the strip is also held by the clamp 146,147 of one of the robot arms 108,109 so that the remaining wrapping material on a roll 106 on the robot tool is ready for a new wrapping procedure. A lose end strip of the wrapping material turned around the coil is preferably arranged to tack to the wrapping by self-adhesive properties. The wrapping material is usually a stretch film in a plastic material.

After the wrapping operation in the wrapping station a crane or similar is used to lift out the wrapped coil to an after-processing station where supplementing packing operations are carried out manually or semi-automatically.

In embodiments, the method is further comprising:

wrapping the curved envelope surface, or cylindrical surface, of the coil by holding, by the respective first and second industrial robot, the longitudinal axis of the roll holder shaft tilted with respect to the direction of rotation of the coil on the curved envelope surface area where the film is applied on the coil.

The roll holder shaft may then be held tilted by the respective first and second industrial robot while moving the robot tool along the curved envelope surface to apply the film on the curved envelope surface, i.e. before, during and after the second handover phase, thereby reducing the risk of creases being formed in the film applied on the envelope surface of the coil.

In embodiments, the longitudinal axis of the roll holder shaft may then be tilted by the second industrial robot while moving the robot tool along a first end surface of the coil and before the sequence of robot movements for wrapping the curved envelope surface of the coil begins.

In embodiments, the longitudinal axis of the roll holder shaft is tilted at an angle within the angle range of 2 to 30 degrees with respect to the direction of rotation of the coil on the curved envelope surface area, or cylindrical surface area, where the film is applied on/to the coil.

In embodiments, the longitudinal axis of the roll holder shaft is straightened/adjusted by the first industrial robot so that it is pointing upwards and directed substantially parallel to the gravitational axis when entering the hollow cylindrical center core from a second end surface of the coil.

In embodiments, the cylindrical direction of the longitudinal axis of the roll holder shaft of the robot tool holding the roll is adjusted before reaching the edge between a first end surface and the curved envelope surface of the coil and while moving the robot tool along the first end surface of the coil.

In different embodiments, the method of wrapping the coil further comprises a selection of:

- placing a coil of sheet metal on a coil roller associated with a robot system for coil packaging;
- measuring the position of the coil in relation to the industrial robots;
- measuring the dimensions of the coil;
- attaching a first turn of wrapping material rolled off from a roll of wrapping material attached to a robot tool; and
- finishing the wrapping by clamping a strip of the wrapping material and cutting the strip of wrapping material.

In embodiments, the method of the technology disclosed comprises:

- wrapping the curved envelope surface, or cylindrical surface, of the coil by holding, by the respective first and second industrial robot, the longitudinal axis of the roll holder shaft tilted with respect to the direction of rotation of the coil on the curved envelope surface area where the film is applied on the coil.

In embodiments, the roll holder shaft is held tilted by the respective first and second industrial robot while moving the robot tool along the curved envelope surface to apply the film on the curved envelope surface, i.e. before, during and after the second handover phase, thereby reducing the risk of creases being formed in the film applied on the envelope surface of the coil.

In embodiments, the longitudinal axis of the roll holder shaft is tilted by the second industrial robot while moving the robot tool along a first end surface of the coil and before the sequence of robot movements for wrapping the curved envelope surface of the coil begins.

In embodiments, the longitudinal axis of the roll holder shaft is straightened/adjusted by the first industrial robot so that it is pointing upwards and directed substantially parallel to the gravitational axis when entering the hollow cylindrical center core from a second end surface of the coil.

In embodiments, the longitudinal axis of the roll holder shaft is tilted at an angle within the angle range of 2 to 30 degrees with respect to the direction of rotation of the coil on the curved envelope surface area, or cylindrical surface area, where the film is applied on the coil.

In embodiments, the coil is rotated about its rotational axis by rotating at least one driver roller of the cradle.

In embodiments, the first handover phase is performed in a first horizontal plane substantially perpendicular to the gravitational axis which is substantially parallel to the rotational axis of the coil and by said first industrial robot handing over the robot tool to said second industrial tool; and wherein said second handover phase is performed in a vertically translated second horizontal plane different from said first horizontal plane by said second industrial robot handing over the robot tool to said first industrial tool.

In embodiments, the robot system comprises two industrial robots, each robot being provided with a robot arm having a coupling robot piece configured to interface with a robot tool having two ends, each end being provided with a coupling tool piece configured to interface with a said robot arm, and a roll holder shaft projecting substantially perpendicular to an axis extending between said two ends.

In embodiments, each of the two industrial robots is configured to tilt the longitudinal axis of the roll holder shaft of the robot tool with respect to the direction of rotation of a coil on the curved envelope surface area of the coil where the film is applied.

In embodiments, the two industrial robots are each configured to hold the longitudinal axis of the roll holder shaft of the robot tool at a substantially constant inclined angle relative the direction of rotation of the envelope surface area of the coil where the film is applied.

In embodiments, each of the two industrial robots are configured to hold the longitudinal axis of the roll holder shaft at a substantially constant angle relative the direction of rotation before, during and after a handover of the robot tool between the two industrial robots along the envelope surface.

In embodiments, the first and second industrial robot are both configured to receive instructions from the control system which cause the robot arm of the respective robot to move in the same horizontal plane during the first handover phase taking place in the hollow cylindrical center core of the coil.

In embodiments, the first and second industrial robot are both configured to receive instructions from the control system which cause the robot arm of the respective robot to hold the robot tool so that the roller holder shaft of the robot tool is directed substantially parallel to the rotational axis of the coil and substantially perpendicular to the gravitational axis along the path of travel for the two robot arms inside the hollow cylindrical center core of the coil.

In embodiments, the second plane of said second handover phase is at a different height position from said first plane of said first handover phase along the axis perpendicular to the rotational axis of the coil.

In embodiments, the height position along the gravitational axis perpendicular to the rotational axis of the coil is adjusted by the respective robot along the respective coil end surface, thereby reducing the risk of creases in the stretch film applied on the envelope surface of the coil.

In embodiments, the technology disclosed relates to a robot system for coil packaging, comprising:

- two industrial robots, each robot being provided with a robot arm having a coupling robot piece configured to interface with a robot tool;
- a robot tool, the robot tool having two ends, each end being provided with a coupling tool piece configured to interface with a said robot arm, and a roll holder shaft configured to hold a roll of packaging material, the roll holder shaft at one end being mounted substantially midway between said ends and projecting substantially perpendicular to an axis extending between said ends.

In embodiments, the robot arm is configured as an elongate beam having said coupling robot piece mounted at the end of the beam.

In embodiments, the coupling robot pieces are configured to be able to convey actuating power from a power supply line of any of said robots.

In embodiments, the coupling between said robots and said robot tool is in the form of a robot tool changer with the coupling tool pieces of the robot tool configured to be able to mate with coupling master piece mounted on each robot arm.

In embodiments, the robot arms each comprises a wrapping material clamp configured to hold a strip of wrapping material, preferably mounted close to the distal end of said robot arm.

In embodiments, the robot system further comprises:

a robot jig having a first and a second intersecting leg;

a first leg of the robot jig being configured with a first and a second robot base mounts placed apart on said first leg;

a second leg of the robot jig being configured with a first coil roller abutment placed at an end of said second leg.

In embodiments, the robot system further comprises at least one coil roller configured to give a coil placed in said first coil roller a rotating movement.

In embodiments, the robot system further comprises a wrapping material clamping station placed substantially midway between said robots, said wrapping material clamping station being provided with a wrapping material clamp configured to hold a strip of wrapping material.

In embodiments, the robot system further comprises a roll magazine for storing a plurality of rolls of wrapping material available to one or more of the robots, the roll magazine being configured with a roll place and an associated wrapping material clamp for each roll of wrapping material, said wrapping material clamps being configured to hold a strip of wrapping material.

In embodiments, the robot system further comprises a measuring system configured to measure the position and dimensions of a coil positioned on a coil roller for being packaged with a wrapping material.

In embodiments, the measuring system comprises one or more laser measuring tools, for example mounted on one of or both robot arms.

In embodiments, the robot system further comprises a robot control system configured to control the movement of the robots in relation to a coil positioned on a coil roller for being packaged with a wrapping material.

In embodiments, the robot control system comprises input/output interfaces configured to be communicatively couplable to the industrial robots, to one or more coil rollers, and/or to a human/machine interface for example in the form of a GUI generating a dashboard.

The invention claimed is:

1. A method for wrapping a coil in a robot system comprising a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between said two ends and carrying a roll of wrapping material, said method comprising wrapping the coil with the wrapping material being rolled off the roll in successive wrapping turns or windings each comprising a sequence of robot movements including two handovers of the robot tool between the two robots per wrapping turn or winding, wherein a first handover phase takes place in a hollow cylindrical center core of the coil and a second handover phase takes place along a cylindrical surface, or curved envelope surface, of the coil, adjusting, by said control system and through said means for conveying a rotational motion of the coil, the angular velocity, or rotational speed, of the coil about its longitudinal axis during the process of wrapping the coil to thereby change the amount of overlap between successive wrapping turns or windings of wrapping material so that the cylindrical surface of the at least one first cylindrical sector segment of the coil is provided with a greater overlap between successive turns or windings of the wrapping material than the overlap of the cylindrical surface of at least one other second cylindrical sector segment of the coil, and positioning, by said control system, the roll holder shaft position in three-dimensional space along a first circumferential edge by determining a start position for the wrapping of the cylindrical surface, or curved envelope surface, of the coil so that the start position is adapted to the currently imposed angular velocity of the coil, and controlling, by said control system, the movement of the robot arms so that a direction of travel of the robot tool and the respective robot arm holding the robot tool along the cylindrical surface, or curved envelope surface, is in a straight direction within an angle range of 0.1 to 15 degrees relative an axis along the curved envelope surface which is parallel to the rotational axis of the coil.

2. The method of claim 1, said method comprising adjusting, by said control system and through said means for conveying a rotational motion to the coil, the angular velocity, or rotational speed, of the coil so that at least one lower angular velocity, or rotational speed, of the coil imposed by said means for conveying a rotational motion to the coil during at least portions of the time for wrapping said at least one first cylindrical sector segment is less than 70% of a higher rotational speed imposed on the coil during the wrapping of said at least one other second cylindrical sector segment of the coil, thereby providing a reinforcement of said at least one first cylindrical sector segment.

3. The method of claim 2, wherein the at least one lower rotational speed imposed by said means for conveying a rotational motion to the coil during the wrapping of said at least one first cylindrical sector segment of the coil provides for overlaps between successive wrapping turns or windings along the cylindrical surface, or curved envelope surface, of said at least one first cylindrical sector segment of the coil that are more than 50% of the width of the roll of the wrapping material, thereby providing a reinforcement of said at least one first cylindrical sector segment.

4. The method of claim 2, wherein the at least one lower rotational speed imposed by said means for conveying a rotational motion to the coil during the wrapping of said at least one first cylindrical sector segment of the coil provides for overlaps between successive wrapping turns or windings along the cylindrical surface, or curved envelope surface, of said at least one first cylindrical sector segment of the coil that are more than 70% of the width of the roll of the wrapping material, thereby providing a reinforcement of said at least one first cylindrical sector segment.

5. The method of claim 2, wherein the at least one lower rotational speed imposed by said means for conveying a rotational motion to the coil during the wrapping of said at least one first cylindrical sector segment of the coil provides for overlaps between successive wrapping turns or windings along the cylindrical surface, or curved envelope surface, of said at least one first cylindrical sector segment of the coil that are more than 90% of the width of the roll of the wrapping material, thereby providing reinforcement of said at least one first cylindrical sector segment.

6. The method of claim 2, wherein the at least one higher rotational speed imposed by said means for conveying a rotational motion to the coil during the wrapping of said at least one other second cylindrical sector segment of the coil provides for overlaps between successive wrapping turns or windings along the cylindrical surface, or curved envelope surface, of said at least one other second cylindrical sector segment of the coil that are less than 45% of the width of the roll of the wrapping material.

7. The method of claim 2, wherein the at least one higher rotational speed imposed by said means for conveying a rotational motion to the coil during the wrapping of said at least one other second cylindrical sector segment of the coil provides for overlaps between successive wrapping turns or windings along the cylindrical surface, or curved envelope surface, of said at least one other second cylindrical sector segment of the coil that are less than 35% of the width of the roll of the wrapping material.

8. The method of claim 2, wherein the at least one higher rotational speed imposed by said means for conveying a rotational motion to the coil during the wrapping of said at least one other second cylindrical sector segment of the coil provides for overlaps between successive wrapping turns or windings along the cylindrical surface, or curved envelope surface, of said at least one other second cylindrical sector segment of the coil that are less than 20% of the width of the roll of the wrapping material.

9. The method of claim 1, said method comprising adjusting, by said control system and through said means for conveying a rotational motion of the coil, the angular velocity, or rotational speed, of the coil so that the coil does not rotate during at least portions of the time period for wrapping said at least one first cylindrical sector segment.

10. The method of claim 1, wherein the angular velocity, or rotational speed, of the coil is adjusted, by said control system and through said means for conveying a rotational motion to the coil, so that the coil is rotating at at least one lower angular velocity, or rotational speed, during at least 5 successive wrapping turns or windings.

11. The method of claim 1, wherein the width of the roll of the wrapping material is in the range 200-300 mm, and wherein the width of the overlaps produced along the cylindrical surface, or curved envelope surface, of said at least one first cylindrical sector segment of the coil is more than 150 mm.

12. The method of claim 1, wherein the process for wrapping the entire coil includes between 15 and 50 wrapping turns or windings.

13. The method of claim 1, further comprising adapting, by said control system, the positioning of the robot arm of the respective robots so that the longitudinal axis of the roll holder shaft of the robot tool holding the roll is directed in an inclined direction relative a direction of rotation of the coil, wherein the roll holder shaft is directed in an inclined direction at least during portions of the movement of the robot tool along the cylindrical surface, or curved envelope surface, of the coil.

14. The method of claim 13, further comprising adaptively controlling, by said control system, the direction of the roll holder shaft relative the direction of rotation of the coil so that the inclination of the shaft is adapted to the angular velocity, or rotational speed, imposed to the coil in that the shaft is inclined by means of the respective robot arms in a greater angle during the use of at least one higher angular velocity than during the use of at least one lower angular velocity of the coil.

15. The method of claim 1, wherein the longitudinal axis of the roll holder shaft of the robot tool is positioned, by the respective robot arm holding the robot tool, at an angle within an angle range of 2 to 30 degrees relative a direction of rotation along the cylindrical surface of the coil where the wrapping material is applied.

16. The method of claim 1, wherein the longitudinal axis of the roll holder shaft of the robot tool is positioned at an angle within an angle range of 3 to 30 degrees relative the direction of rotation of a sub-area of the curved envelope surface where the wrapping material is applied.

17. A robot system comprising a cradle for carrying the coil, a control system, means for conveying a rotational motion to the coil and two industrial robots, each industrial robot being provided with at least one robot arm having a coupling robot piece configured to interface with a robot tool having two ends each configured to interface with the coupling robot piece of the at least one robot arm, and a roll holder shaft projecting substantially perpendicular to an axis extending between said two ends and carrying a roll of wrapping material, wherein said control system is configured to;

control the movements of the robots in relation to the coil in order to wrap the coil with the wrapping material in successive wrapping turns or windings each comprising a sequence of robot movements including two handovers of the robot tool between the two robots per wrapping turn where a first handover phase takes place in a hollow cylindrical center core of the coil and a second handover phase takes place along a curved envelope surface of the coil, adjust, through said means for conveying a rotational motion of the coil, an angular velocity, or rotational speed, of the coil about its rotational axis during the process of wrapping the coil to thereby change the amount of overlap between successive wrapping turns or windings so that the cylindrical surface of at least one first cylindrical sector segment of the coil is provided with a greater overlap between successive turns or windings than the overlap of the cylindrical surface of at least one other second cylindrical sector segment of the coil, control said means for conveying a rotational motion to the coil in order to adjust and change the angular velocity, or rotational speed, of the coil about its rotational axis during the process of wrapping the coil to thereby change the amount of overlap between successive wrapping turns or windings of wrapping material so that the cylindrical surface of at least one first cylindrical sector segment of the coil is provided with a greater overlap between successive turns or windings of the wrapping material than the overlap of the cylindrical surface of at least one other second cylindrical sector segment of the coil, control positioning of the roll holder shaft in three-dimensional space along a first circumferential edge by determining a start position for the wrapping of the cylindrical surface, or curved envelope surface, of the coil so that the start position is adapted to the currently imposed angular velocity of the coil, and control the movement of the robot arms so that a direction of travel of the robot tool and the respective robot arm holding the robot tool along the cylindrical surface, or curved envelope surface, is in a straight direction within an angle range of 0.1 to 15 degrees relative an axis along the curved envelope surface which is parallel to the rotational axis of the coil.

18. The robot system according to claim 17, wherein said control system and through said means for conveying a rotational motion to the coil, is configured to adjust and change the angular velocity, or rotational speed, of the coil so that at least one lower angular velocity, or rotational speed, of the coil imposed by said means for conveying a rotational motion to the coil during at least portions of the time for wrapping said at least one first cylindrical sector segment is less than 70% of a higher rotational speed imposed on the coil during the wrapping of said at least one other second cylindrical sector segment of the coil, thereby providing a reinforcement of said at least one first cylindrical sector segment.

19. The robot system according to claim 18, wherein said control system and through said means for conveying a rotational motion to the coil, is configured to adjust and change the angular velocity, or rotational speed, of the coil during the wrapping process so that the at least one lower rotational speed imposed by said means for conveying a rotational motion to the coil during the wrapping of said at least one first cylindrical sector segment of the coil provides for overlaps between successive wrapping turns or windings along the cylindrical surface, or curved envelope surface, of said at least one first cylindrical sector segment of the coil that are more than 50% of the width of the roll of the wrapping material, thereby providing a reinforcement of said at least one first cylindrical sector segment.

20. The robot system according to claim 18, wherein said control system and through said means for conveying a rotational motion to the coil, is configured to adjust and change the angular velocity, or rotational speed, of the coil during the wrapping process so that the at least one higher rotational speed imposed by said means for conveying a rotational motion to the coil during the wrapping of said at least one other second cylindrical sector segment of the coil provides for overlaps between successive wrapping turns or windings along the cylindrical surface, or curved envelope surface, of said at least one other second cylindrical sector segment of the coil that are less than 35% of the width of the roll of the wrapping material.

21. The robot system according to claim 17, wherein said control system and through said means for conveying a rotational motion to the coil, is configured to adjust and change the angular velocity, or rotational speed, of the coil so that the coil does not rotate during at least portions of the time period for wrapping said at least one first cylindrical sector segment.

22. The robot system according to claim 17, wherein said control system and through said means for conveying a rotational motion to the coil, is configured to adjust and change the angular velocity, or rotational speed, of the coil during the wrapping process so that the coil is rotating at at least one lower angular velocity, or rotational speed, during at least 5 successive wrapping turns or windings.

* * * * *